US010562315B2

(12) United States Patent
Shinoda et al.

(10) Patent No.: US 10,562,315 B2
(45) Date of Patent: Feb. 18, 2020

(54) LIQUID EJECTING APPARATUS AND FILLING METHOD OF LIQUID EJECTING APPARATUS

(71) Applicant: SEIKO EPSON CORPORATION, Tokyo (JP)

(72) Inventors: Tomoki Shinoda, Shiojiri (JP); Takeshi Iwamuro, Matsumoto (JP); Toshihiro Shinbara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/007,764

(22) Filed: Jun. 13, 2018

(65) Prior Publication Data

US 2018/0361751 A1 Dec. 20, 2018

(30) Foreign Application Priority Data

Jun. 15, 2017 (JP) ..... 2017-117475

(51) Int. Cl.
*B41J 2/175* (2006.01)
*B41J 29/02* (2006.01)

(52) U.S. Cl.
CPC ..... *B41J 2/17563* (2013.01); *B41J 2/175* (2013.01); *B41J 2/17506* (2013.01); *B41J 2/17509* (2013.01); *B41J 29/02* (2013.01)

(58) Field of Classification Search
CPC .... B41J 2/17563; B41J 2/175; B41J 2/17509; B41J 29/02; B41J 2/17506
See application file for complete search history.

(56) References Cited

U.S. PATENT DOCUMENTS

2006/0082621 A1 4/2006 Tsukada et al.
2006/0176346 A1 8/2006 Momose
2010/0103208 A1 4/2010 Asami et al.
2012/0038721 A1* 2/2012 Yokouchi ..... B41J 2/17509 347/93
2015/0130872 A1 5/2015 Okina
2015/0314607 A1* 11/2015 Moriguchi ..... B05B 7/24 347/85

FOREIGN PATENT DOCUMENTS

JP 2000-127455 A 5/2000
JP 2005-349668 A 12/2005
JP 2006-137181 A 6/2006
JP 2006-198846 A 8/2006
JP 2008-230012 A 10/2008
(Continued)

*Primary Examiner* — Yaovi M Ameh
(74) *Attorney, Agent, or Firm* — Workman Nydegger

(57) ABSTRACT

In a filling operation of filling liquid in a liquid supply flow path which includes a filter having holes by causing a pressure on a downstream side in the liquid supply flow path to be lower than a pressure on an upstream side, and a maximum pressure difference which occurs between an upstream side of the filter and a downstream side of the filter is larger than a pressure difference for destroying a gas-liquid interface formed in the hole in a case where the upstream side of the filter is the liquid, and the downstream side of the filter is gas, and is smaller than a pressure difference for destroying the gas-liquid interface formed in the hole, in a case where the upstream side of the filter is the gas, and the downstream side of the filter is the liquid.

7 Claims, 8 Drawing Sheets

(56) References Cited

FOREIGN PATENT DOCUMENTS

| | | | |
|---|---|---|---|
| JP | 2009-143046 | A | 7/2009 |
| JP | 2011-062858 | A | 3/2011 |
| JP | 2011-235470 | A | 11/2011 |
| JP | 2012-051277 | A | 3/2012 |
| JP | 2013-193445 | A | 9/2013 |
| JP | 2015-063109 | A | 4/2015 |
| JP | 2015-093460 | A | 5/2015 |

* cited by examiner

FIG. 11

| No. | STAINLESS STEEL MESH FILTER | | | LIQUID | | EVALUATION RESULT | | | | | |
|---|---|---|---|---|---|---|---|---|---|---|---|
| | TYPE | MESH | NOMINAL FILTRATION GRAIN SIZE (μm) | TYPE | SURFACE TENSION (mN/m) | PRESSURE DIFFERENCE ON UPSTREAM SIDE AND DOWNSTREAM SIDE IN FILTER (kPa) | | | | | |
| | | | | | | 10 | 20 | 30 | 40 | 50 | 60 |
| 1 | TWILL MAT WEAVING | 2300 | 10 TO 11 | A | 23.6 | ○ | × | – | – | – | – |
| 2 | TWILL MAT WEAVING | 2800 | 5 TO 8 | A | 23.6 | ○ | ○ | × | – | – | – |
| 3 | TWILL MAT WEAVING | 3600 | 4 TO 6 | A | 23.6 | ○ | ○ | ○ | × | – | – |
| 4 | TWILL MAT WEAVING | 2800 | 5 TO 8 | B | 58.6 | ○ | ○ | ○ | ○ | ○ | × |

LIQUID EJECTING APPARATUS AND FILLING METHOD OF LIQUID EJECTING APPARATUS

BACKGROUND

1. Technical Field

The present invention relates to a liquid ejecting apparatus such as a printer, and a filling method of the liquid ejecting apparatus.

2. Related Art

As an example of a liquid ejecting apparatus, there is an ink jet recording apparatus which performs printing by discharging (ejecting) ink (liquid) supplied from an ink cartridge (liquid supply source) through an ink flow path (liquid supply flow path) from a recording head (liquid ejecting unit) onto a recording sheet (for example, JP-A-2000-127455). The recording apparatus is provided with a cap member which caps the recording head, and a suctioning pump which suctions ink from the recording head by applying a negative pressure in an internal space of the cap member.

The ink flow path includes a tapered space portion, and a filter member (filter) is provided in the tapered space portion. When such an ink flow path is filled with ink, there is a case in which air bubbles (gas) remain in the tapered space portion (filter chamber on upstream side) on an upstream side of the filter member.

For this reason, the recording apparatus suctions ink at a high flow rate with which air bubbles pass through the filter member, after suctioning ink at a low flow rate with which air bubbles come into contact with the filter member, by driving the suctioning pump, and discharges the air bubbles from the recording head. However, when the air bubbles are discharged from the recording head, there is a case in which a part of the air bubbles is not discharged, remains in the recording head, and as a result, discharging of ink becomes unstable.

Such a problem is not limited to a recording apparatus provided with a filter member which is provided in an ink flow path, and is approximately common to a liquid ejecting apparatus provided with a filter which is provided in a liquid supply flow path, and a filling method of the liquid ejecting apparatus.

SUMMARY

An advantage of some aspects of the invention is to provide a liquid ejecting apparatus in which it is possible to properly fill a liquid supply flow path with liquid, even in a case in which a filter is provided in the liquid supply flow path, and a filling method of the liquid ejecting apparatus.

Hereinafter, means of the invention will be described.

According to an aspect of the invention, there is provided a liquid ejecting apparatus which includes a liquid ejecting unit which includes a nozzle opening which ejects liquid; a liquid supply flow path through which the liquid can be supplied to the nozzle opening of the liquid ejecting unit from a liquid supply source; and a filter portion which includes a filter which is provided with a plurality of holes through which a fluid can pass, the filter collecting foreign substances, and the filter portion configuring a part of the liquid supply flow path, in which in the liquid supply flow path, in a case in which the liquid supply source side is set to an upstream side, and the nozzle opening side is set to a downstream side, a maximum pressure difference which occurs between an upstream side filter chamber as an upstream side of the filter and a downstream side filter chamber as a downstream side of the filter, in the filter portion, is larger than a pressure difference for destroying a gas-liquid interface which is formed in the hole in a case in which the upstream side of the filter is the liquid, and the downstream side of the filter is gas, and is smaller than a pressure difference for destroying the gas-liquid interface which is formed in the hole in a case in which the upstream side of the filter is the gas, and the downstream side of the filter is the liquid, in a filling operation in which the liquid supply flow path in a state of not being filled with the liquid is filled with the liquid in the liquid supply source, by causing a pressure to be operated so as to make a pressure on the downstream side lower than a pressure on the upstream side.

According to another aspect of the invention, there is provided a filling method of a liquid ejecting apparatus which includes a liquid ejecting unit including a nozzle opening which ejects liquid; a liquid supply flow path through which the liquid can be supplied to the nozzle opening of the liquid ejecting unit from a liquid supply source; and a filter portion which includes a filter which is provided with a plurality of holes through which a fluid can pass, the filter collecting foreign substances, and the filter portion configuring a part of the liquid supply flow path, in which, in the liquid supply flow path, in a case in which the liquid supply source side in the liquid supply flow path is set to an upstream side, and the nozzle opening side is set to a downstream side, the liquid supply flow path in a state of not being filled with liquid is filled with the liquid in the liquid supply source by causing a pressure to be operated so as to make a pressure on the downstream side lower than a pressure on the upstream side, the method including: in the filter portion, a maximum pressure difference which occurs between an upstream side filter chamber as an upstream side of the filter and a downstream side filter chamber as a downstream side of the filter to be larger than a pressure difference for destroying a gas-liquid interface which is formed in the hole, in a case in which the upstream side of the filter is the liquid, and the downstream side of the filter is gas; and causing the maximum pressure difference to be smaller than a pressure difference for destroying the gas-liquid interface which is formed in the hole, in a case in which the upstream side of the filter is the gas, and the downstream side of the filter is the liquid.

BRIEF DESCRIPTION OF THE DRAWINGS

The invention will be described with reference to the accompanying drawings, wherein like numbers reference like elements.

FIG. 11 is a table which denotes a pressure with which the second gas-liquid interface is destroyed.

DESCRIPTION OF EXEMPLARY EMBODIMENTS

Hereinafter, a liquid ejecting apparatus according to one embodiment will be described while referring the drawings. In addition, the liquid ejecting apparatus in the embodiment is an ink jet printer which prints characters or an image by ejecting ink as an example of liquid onto a medium such as a sheet. In addition, the liquid ejecting apparatus in the embodiment is also a large format printer which performs printing on a long medium.

Figure 1:
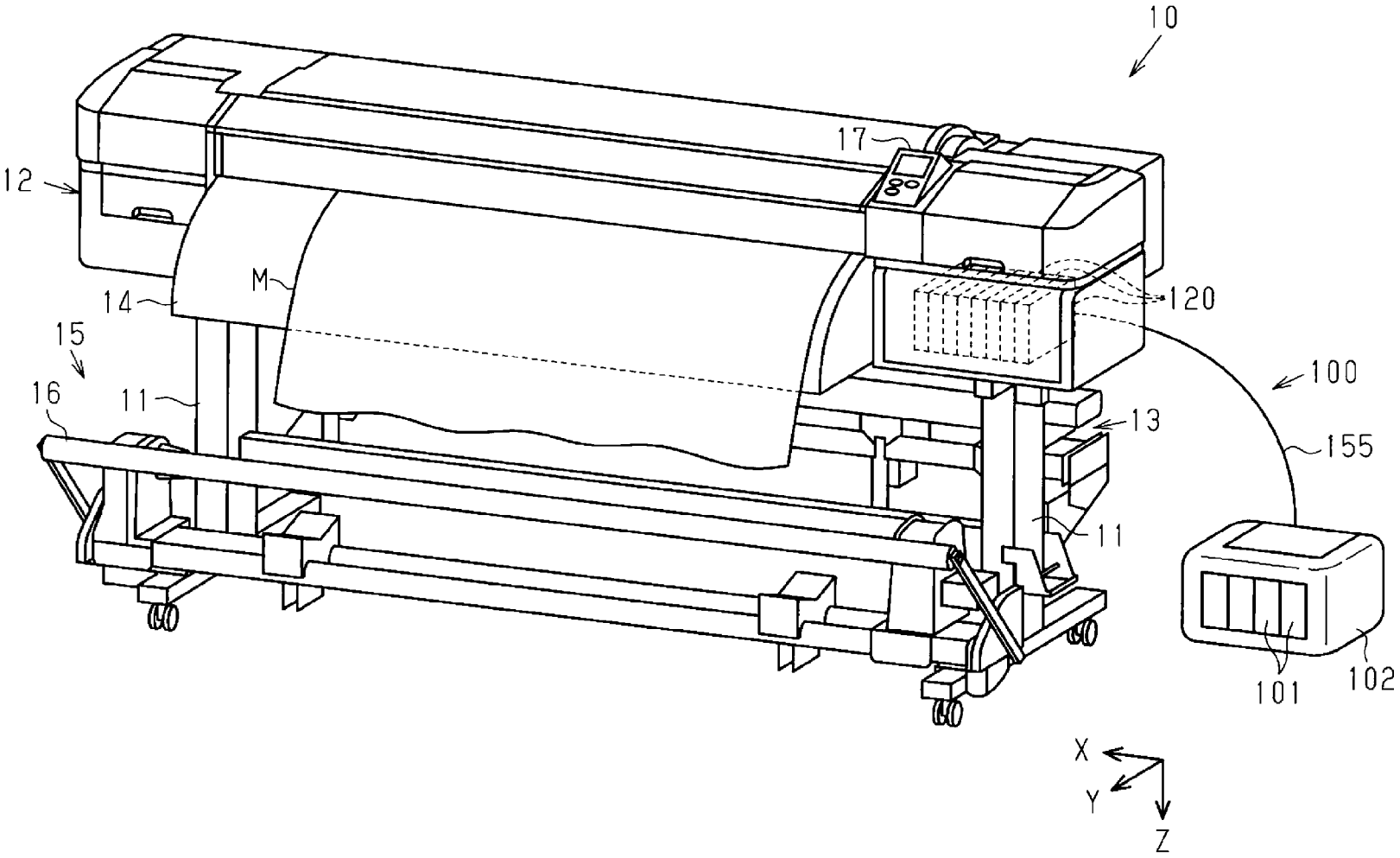
FIG. 1 is a perspective view of a liquid ejecting apparatus according to one embodiment.

As illustrated in FIG. 1, a liquid ejecting apparatus 10 is provided with a pair of leg portions 11, a housing 12 which is assembled on the leg portion 11, a sending unit 13 which sends a medium M which is wound around a roll body in an overlapping manner toward the inside of the housing 12, a guide unit 14 which guides the medium M discharged from the housing 12, and a winding unit 15 which winds the medium M guided to the guide unit 14 around the roll body. In addition, the liquid ejecting apparatus 10 is provided with a tension apply medium 16 which applies a tension to the medium M which is wound around the winding unit 15, and an operation panel 17 which is operated by a user.

In the embodiment, a longitudinal direction of the liquid ejecting apparatus 10 is set to a "width direction", a depth direction of the liquid ejecting apparatus 10 is set to a front/rear direction", and a vertical direction of the liquid ejecting apparatus 10 which is also a longitudinal direction of the leg portion 11 is set to a "vertical direction". In a figure, the width direction is denoted by an X axis, the front/rear direction is denoted by a Y axis, and the vertical direction is denoted by a Z axis. Here, the width direction, the front/rear direction, and the vertical direction are directions which are orthogonal to each other.

Figure 2:
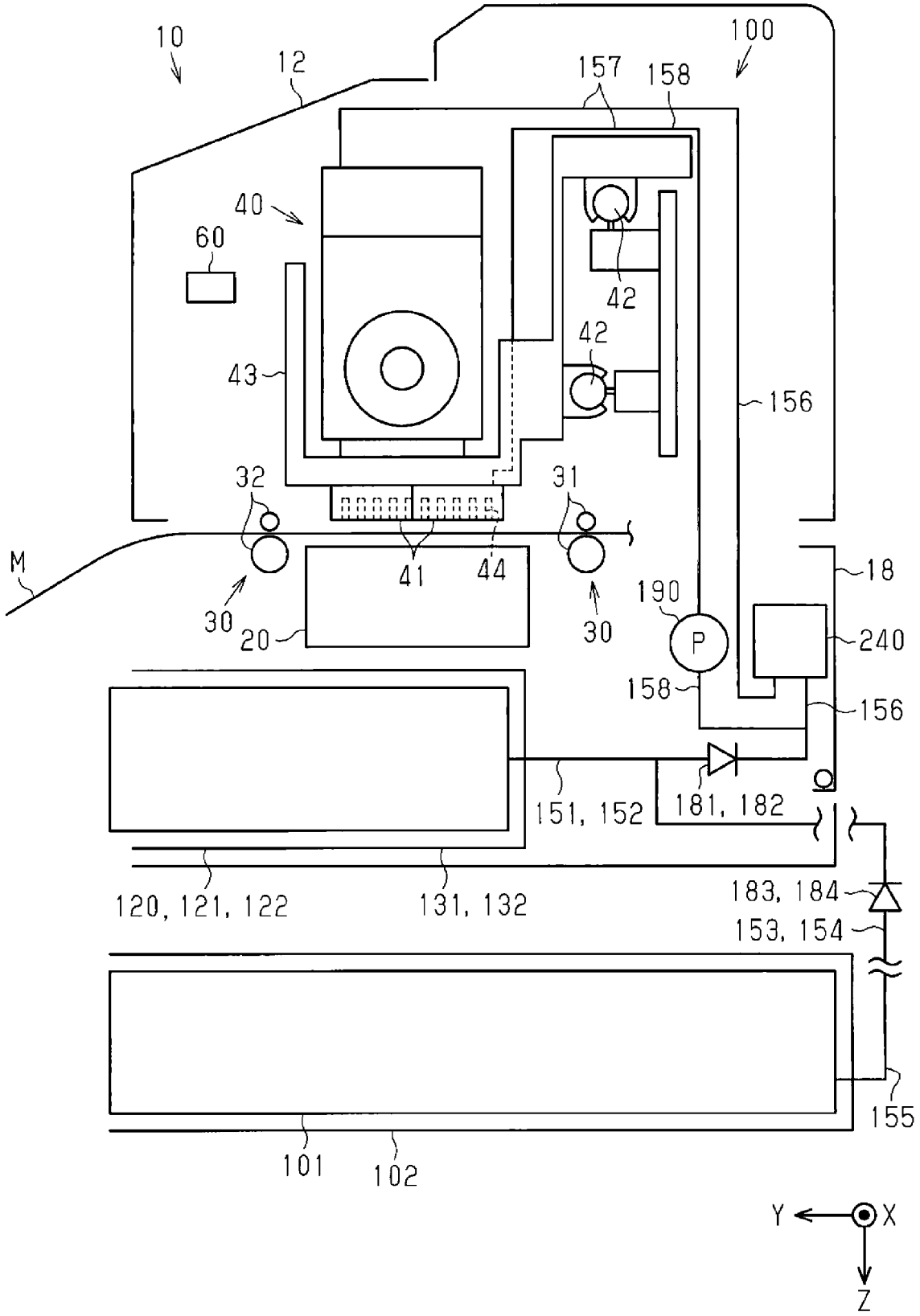
FIG. 2 is a side view which illustrates a schematic configuration of the liquid ejecting apparatus.

As illustrated in FIG. 2, the liquid ejecting apparatus 10 is provided with a support table 20 which supports the medium M, a transport unit 30 which transports the medium M, a printing unit 40 which performs printing on the medium M, a maintenance unit 50 (refer to FIG. 3) which performs maintenance of the printing unit 40, and a control unit 60 which controls an operation of the liquid ejecting apparatus 10. In addition, as illustrated in FIGS. 1 and 2, the liquid ejecting apparatus 10 is provided with a liquid supply device 100 which supplies liquid to the printing unit 40.

As illustrated in FIG. 2, the support table 20 extends in the width direction of the medium M which is orthogonal to (intersects) the transport direction of the medium M. The transport unit 30 is provided with a pair of transport rollers 31 and 32 which are disposed on both sides of the support table 20 in the transport direction. In addition, the medium M which is interposed between the pair of transport rollers 31 and 32 is transported in the transport direction along the surface of the support table 20 when the pair of transport rollers 31 and 32 is driven by a transport motor (not illustrated).

The printing unit 40 is provided with a liquid ejecting unit 41 which ejects liquid, a guide axis 42 which extends in the width direction, and a carriage 43 which can reciprocate in the width direction by being guided by the guide axis 42. The carriage 43 moves along with driving of a carriage motor (not illustrated).

Figure 3:
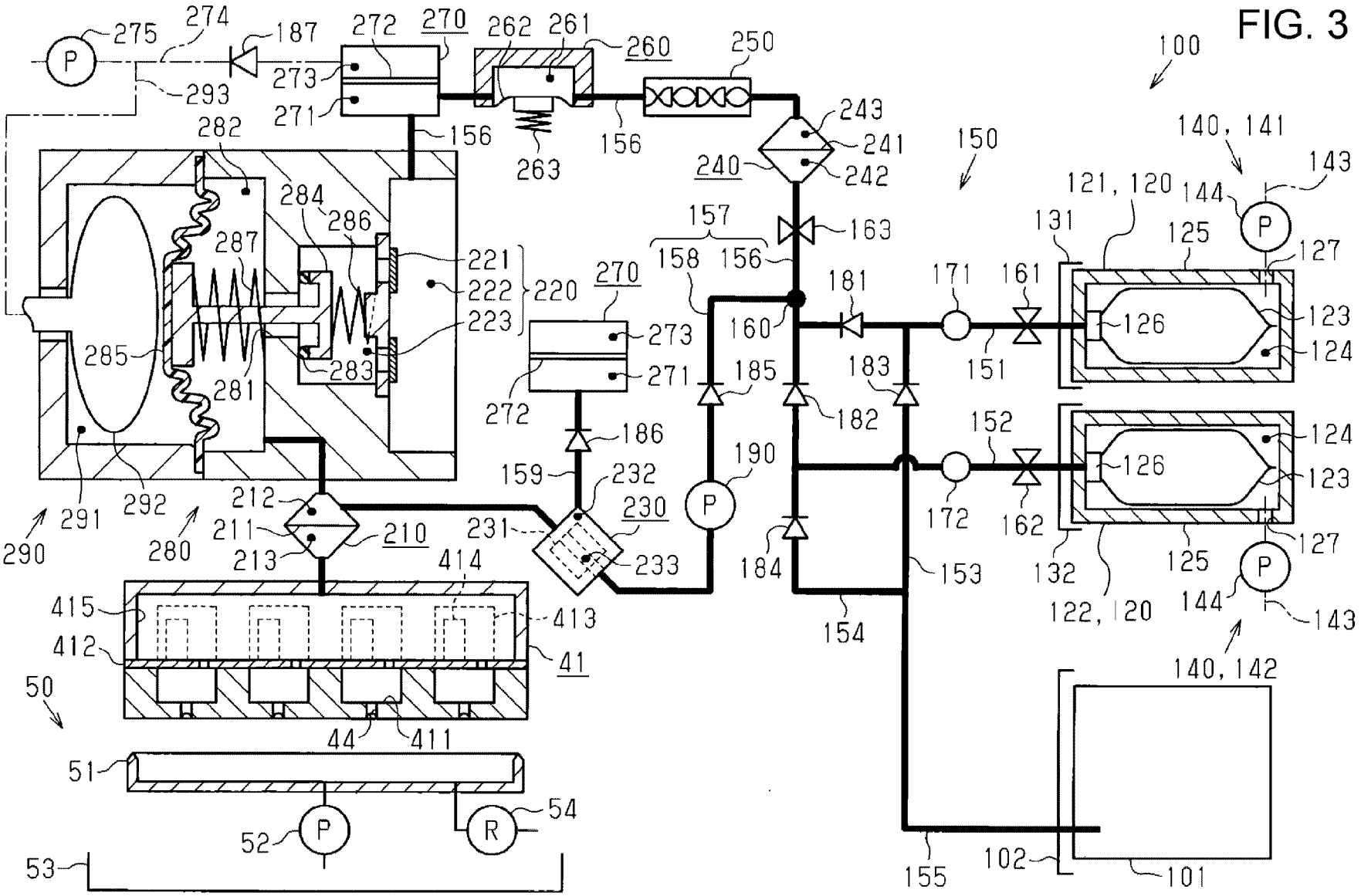
FIG. 3 is a schematic view which illustrates a liquid supply device provided in the liquid ejecting apparatus.

As illustrated in FIG. 3, the liquid ejecting unit 41 includes a nozzle opening 44 which ejects liquid. The liquid ejecting unit 41 is provided with an individual liquid chamber 411 which communicates with the nozzle opening 44, an accommodating unit 413 which is partitioned by the individual liquid chamber 411 and a vibrating plate 412, and an actuator 414 which is accommodated in the accommodating unit 413. The liquid ejecting unit 41 is provided with a common liquid chamber 415 which supplies liquid to a plurality of the individual liquid chambers 411 by temporarily storing liquid which is supplied.

The actuator 414 is a piezoelectric element which contracts in a case in which a driving voltage is applied, for example. When applying of the driving voltage is released after the vibrating plate 412 is deformed along with the contraction of the actuator 414, liquid in the individual liquid chamber 411 of which a volume is changed is ejected from the nozzle opening 44.

The maintenance unit 50 is provided with a cap 51 which can cover the nozzle opening 44 of the liquid ejecting unit 41. The cap 51 caps the liquid ejecting unit 41 by setting a space to which the nozzle opening 44 is open to a closed space. Capping is performed in order to suppress drying of the nozzle opening 44, or the like. The maintenance unit 50 is provided with a suctioning pump 52 which suctions inside the cap 51, a wasted liquid tank 53 which collects wasted liquid and a regulator 54 which adjusts a pressure in the cap 51.

When the suctioning pump 52 is driven in a state in which the liquid ejecting unit 41 is capped, a negative pressure is operated in the nozzle opening 44, and a so-called suctioning cleaning in which liquid is forcibly discharged from the nozzle opening 44 is performed. The regulator 54 causes the cap 51 and ambient air to communicate in a case in which a pressure in the cap 51 is lower than a predetermined pressure (for example, −20 kPa). That is, the regulator 54 adjusts a pressure in the cap 51 so as to be a predetermined pressure by taking air into the cap 51.

Subsequently, one embodiment of the liquid supply device 100 will be described.

The liquid ejecting apparatus 10 is provided with the liquid supply device 100 in each type of liquid which is ejected from the liquid ejecting unit 41. For example, when it is a printer, the liquid supply device 100 is provided in each color of ink.

As illustrated in FIG. 3, the liquid supply device 100 is provided with a liquid supply source holding unit 102 which holds a liquid supply source 101 as a supply source of liquid with respect to the liquid ejecting unit 41. The liquid supply source 101 may have a configuration of accommodating liquid, and for example, may be a cartridge type which can be exchanged, or may be a tank type in which liquid-refilling can be performed. In addition, in a case of setting the liquid supply source 101 to the cartridge type, it is preferable that the liquid supply source holding unit 102 detachably hold the liquid supply source 101, and in a case of setting the liquid supply source 101 to the tank type, it is preferable that the liquid supply source holding unit 102 hold the liquid supply source 101 in an undetachable manner.

In the downstream side of the liquid supply source 101, the liquid supply device 100 is provided with a first intermediate storage body 121 (120) and a second intermediate storage body 122 (120) which store liquid supplied from the liquid supply source 101. In addition, the liquid supply device 100 is provided with a first intermediate storage body holding unit 131 which holds the first intermediate storage body 121, a second intermediate storage body holding unit 132 which holds the second intermediate storage body 122, and a pressure adjusting mechanism 140 which adjusts a pressure in the intermediate storage body 120.

As illustrated in FIG. 2, the intermediate storage body 120 (121, 122) is located on the higher part of the liquid supply source 101 in the vertical direction, and is located on the lower part of the liquid ejecting unit 41 (opening position of nozzle opening 44) in the vertical direction.

As illustrated in FIG. 3, the liquid supply device 100 is provided with a liquid supply flow path 150 which can supply liquid to the nozzle opening 44 of the liquid ejecting unit 41 from the liquid supply source 101. The liquid supply flow path 150 includes a first liquid flow path 151 to a sixth liquid flow path 156, and in addition, the individual liquid chamber 411 and the common liquid chamber 415 function as a part of the liquid supply flow path 150. The liquid supply device 100 is provided with a fluid flow path 158 which forms a circulating flow path 157 through which liquid circulates, and a discharging flow path 159 from which a fluid can be discharged to the outside of the circulating flow path 157, along with the liquid supply flow path 150. In the following descriptions, in the liquid supply flow path 150, the liquid supply source 101 side is referred to as the upstream side, and the nozzle opening 44 side is referred to as the downstream side.

The liquid supply device 100 is provided with the liquid supply flow path 150, the fluid flow path 158, a first on-off valve 161 to a third on-off valve 163 which are provided in the discharging flow path 159, a first flow rate sensor 171, a second flow rate sensor 172, and a first check valve 181 to a sixth check valve 186. The liquid supply device 100 is provided with a circulating pump 190 which is provided in the circulating flow path 157, a first filter portion 210 to a fourth filter portion 240, a static mixer 250, a liquid storage unit 260, a degassing mechanism 270, and a liquid pressure adjusting mechanism 280.

The first liquid flow path 151 connects the first intermediate storage body 121 and the sixth liquid flow path 156. An upstream end of the first liquid flow path 151 is connected to the first intermediate storage body 121 (first intermediate holding unit 131), and a downstream end of the first liquid flow path 151 is connected a downstream end of the second liquid flow path 152 and an upstream end of the sixth liquid flow path 156. The first on-off valve 161, the first flow rate sensor 171, and the first check valve 181 are provided in order from the upstream side, in the first liquid flow path 151.

The second liquid flow path 152 connects the second intermediate storage body 122 and the sixth liquid flow path 156. An upstream end of the second liquid flow path 152 is connected to the second intermediate storage body 122 (second intermediate storage body holding unit 132), and a downstream end of the second liquid flow path 152 is connected to a downstream end of the first liquid flow path 151 and an upstream end of the sixth liquid flow path 156. The second on-off valve 162, the second flow rate sensor 172, and the second check valve 182 are provided in order from the upstream side, in the second liquid flow path 152.

The third liquid flow path 153 connects the first liquid flow path 151 and the fifth liquid flow path 155. An upstream end of the third liquid flow path 153 is connected to a downstream end of the fifth liquid flow path 155 and an upstream end of the fourth liquid flow path 154, and a downstream end of the third liquid flow path 153 is connected to a position between the first flow rate sensor 171 and the first check valve 181 in the first liquid flow path 151. A third check valve 183 is provided in the third liquid flow path 153.

The fourth liquid flow path 154 connects the second liquid flow path 152 and the fifth liquid flow path 155. An upstream end of the fourth liquid flow path 154 is connected to a downstream end of the fifth liquid flow path 155 and an upstream end of the third liquid flow path 153, and a downstream end of the fourth liquid flow path 154 is connected to a position between the second flow rate sensor 172 and the second check valve 182 in the second liquid flow path 152. A fourth check valve 184 is provided in the fourth liquid flow path 154.

The fifth liquid flow path 155 connects the third liquid flow path 153, the fourth liquid flow path 154, and the liquid supply source 101. The upstream end of the fifth liquid flow path 155 is connected to the liquid supply source 101 (liquid supply source holding unit 102), and the downstream end of the fifth liquid flow path 155 is connected to the upstream end of the third liquid flow path 153 and the upstream end of the fourth liquid flow path 154.

The sixth liquid flow path 156 connects the first liquid flow path 151, the second liquid flow path 152, and the liquid ejecting unit 41. The upstream end of the sixth liquid flow path 156 is connected to the downstream end of the first liquid flow path 151 and the downstream end of the second liquid flow path 152, and the downstream end of the sixth liquid flow path 156 is connected to the common liquid chamber 415. The third on-off valve 163, the fourth filter portion 240, the static mixer 250, the liquid storage unit 260, the degassing mechanism 270, the second filter portion 220, the liquid pressure adjusting mechanism 280, and the first filter portion 210 are provided in order from the upstream side, in the sixth liquid flow path 156.

Both ends of the fluid flow path 158 are connected to the sixth liquid flow path 156. One end of the fluid flow path 158 is connected to the first filter portion 210 which configures the sixth liquid flow path 156, and the other end of the fluid flow path 158 is connected to a connection portion 160 which is located on the upstream side of the third on-off valve 163 in the sixth liquid flow path 156. Specifically, the one end of the fluid flow path 158 is connected to a first upstream side filter chamber 212 included in the first filter portion 210. The other end of the fluid flow path 158 is connected to the upstream side of the first upstream side filter chamber 212 in the liquid supply flow path 150. For this reason, the fluid flow path 158 can discharge the fluid in the first upstream side filter chamber 212 to the outside of the first upstream side filter chamber 212 without passing through the first downstream side filter chamber 213. The third filter portion 230, the circulating pump 190, and a fifth check valve 185 are provided in order from the first filter portion 210, in the fluid flow path 158.

A discharging flow path 159 is connected to the third filter portion 230. A sixth check valve 186 and the degassing mechanism 270 are provided in order from the third filter portion 230 side which is the upstream side, in the discharging flow path 159. That is, the liquid supply device 100 in the embodiment is provided with a plurality of (two) the degassing mechanisms 270 which are provided in the sixth liquid flow path 156 and the discharging flow path 159. By providing the degassing mechanism 270 in the discharging flow path 159, the discharging flow path 159 can discharge a fluid to the outside of the circulating flow path 157.

The flow paths such as the liquid supply flow path 150, the fluid flow path 158, and the discharging flow path 159 may be flow paths through which liquid can flow. For example, the flow paths may be formed in a tube which can be elastically deformed, may be formed inside a flow path forming member formed of a hard resin material, or may be formed by bonding a film member to a flow path forming member in which a groove is formed.

Subsequently, one embodiment of the intermediate storage body 120 will be described.

As illustrated in FIG. 3, the first intermediate storage body 121 and the second intermediate storage body 122 are provided corresponding to one liquid supply source 101. That is, according to the embodiment, liquid supplied from one liquid supply source 101 is stored in two intermediate storage bodies 120. In addition, it also can be said that the first intermediate storage body 121 is provided in the first liquid flow path 151, and the second intermediate storage body 122 is provided in the second liquid flow path 152.

The first intermediate storage body 121 and the second intermediate storage body 122 include a liquid accommodating unit 123 which is formed in a bag shape using a flexible member so as to accommodate liquid, and a case 125 in which an accommodating space 124 for accommodating the liquid accommodating unit 123 is formed. In the liquid accommodating unit 123, a liquid connection port 126 which causes the inside of the liquid accommodating unit 123 and the first liquid flow path 151, or the second liquid flow path 152 to communicate is provided. In addition, in the case 125, a pressure adjusting port 127 which can communicate with the accommodating space 124 and the pressure adjusting mechanism 140 is provided. It is preferable that the accommodating space 124 of the case 125 be set to a closed space, and that inflow and outflow of gas do not occur, except for the pressure adjusting port 127.

The upstream end of the first liquid flow path 151 is connected to the first intermediate storage body holding unit 131, and the upstream end of the second liquid flow path 152 is connected to the second intermediate storage body holding unit 132. In addition, the first intermediate storage body holding unit 131 and the second intermediate storage body holding unit 132 detachably hold the intermediate storage body 120. For this reason, by detaching the first intermediate storage body 121 from the first intermediate storage body holding unit 131, it is possible to separate the first intermediate storage body 121 from the first liquid flow path 151, and it is possible to separate the second intermediate storage body 122 from the second liquid flow path 152, by detaching the second intermediate storage body 122 from the second intermediate storage body holding unit 132.

Subsequently, one embodiment of the pressure adjusting mechanism 140 will be described.

The pressure adjusting mechanism 140 includes a first pressure adjusting mechanism 141 which adjusts a pressure in the first intermediate storage body 121, and a second pressure adjusting mechanism 142 which adjusts a pressure in the second intermediate storage body 122. The first pressure adjusting mechanism 141 and the second pressure adjusting mechanism 142 include a pressure adjusting flow path 143 which is connected to the pressure adjusting port 127 of the intermediate storage body 120 without a gap, and a pressure adjusting pump 144 which is provided in the pressure adjusting flow path 143. In addition, by driving the pressure adjusting pump 144, the pressure adjusting mechanism 140 pressurizes the inside of the intermediate storage body 120 by sending gas to the accommodating space 124 of the case 125, or depressurizes the inside of the intermediate storage body 120 by discharging gas from the accommodating space 124 of the case 125.

The pressure adjusting mechanism 140 is provided in each of the intermediate storage bodies 120. For this reason the pressure adjusting mechanism 140 can depressurize the accommodating space 124 of the other intermediate storage body 120 while pressurizing the accommodating space 124 of one intermediate storage body 120 in the first intermediate storage body 121 and the second intermediate storage body 122. In addition, in the following descriptions, pressurizing the accommodating space 124 of the intermediate storage body 120 is simply referred to as "pressurizing the inside of the intermediate storage body 120", and depressurizing the accommodating space 124 of the intermediate storage body 120 is simply referred to as "pressurizing the inside of the intermediate storage body 120".

Subsequently, the first on-off valve 161 to the third on-off valve 163, the first flow rate sensor 171, the second flow rate sensor 172, and the first check valve 181 to the sixth check valve 186 will be described.

The first on-off valve 161 is a valve which can switch between an open state which allows a flow of liquid in the first liquid flow path 151, and a closed state which blocks a flow of liquid in the first liquid flow path 151. The first on-off valve 161 suppresses leaking of liquid from the upstream end of the first liquid flow path 151 by entering a closed state when detaching the first intermediate storage body 121 from the first intermediate storage body holding unit 131.

The second on-off valve 162 is a valve is a valve which can switch between an open state which allows a flow of liquid in the second liquid flow path 152, and a closed state which blocks a flow of liquid in the second liquid flow path 152. The second on-off valve 162 suppresses leaking of liquid from the upstream end of the second liquid flow path 152 by entering a closed state when detaching the second intermediate storage body 122 from the second intermediate storage body holding unit 132.

The third on-off valve 163 is a valve which can switch between an open state which allows a flow of liquid in the sixth liquid flow path 156 is allowed, and a closed state which blocks a flow of liquid in the sixth liquid flow path 156. The third on-off valve 163 can accumulate a negative pressure which is caused to be operated in the nozzle opening 44 by the maintenance unit 50, by entering a closed state when the maintenance unit 50 performs maintenance of the liquid ejecting unit 41. That is, when the third on-off valve 163 is open in a state of accumulating a negative pressure, it becomes so-called choke cleaning in which liquid is discharged from the nozzle opening 44 with a great force.

The first on-off valve 161 to the third on-off valve 163 may be electromagnetic valves (solenoid valve) which cause a valve to be open or closed using a solenoid, may be motor operated valves which cause a valve to be open or closed by an electric motor, may be fluid pressure valves which cause a valve to be open or closed by a fluid pressure cylinder, or may be control valves other than those.

The first flow rate sensor 171 detects a flow rate of liquid which flows in the first liquid flow path 151, and the second flow rate sensor 172 detects a flow rate of liquid which flows in the second liquid flow path 152. In addition, the first flow rate sensor 171 and the second flow rate sensor 172 may be an electromagnetic flowmeter, may be a Coriolis flowmeter, may be an ultrasonic flowmeter, or may be a flowmeter other than those.

The first check valve 181 to the sixth check valve 186 allow a flow of fluid from the upstream side to the downstream side, and meanwhile regulates a flow of fluid from the downstream side to the upstream side.

The first check valve 181 allows a flow of fluid from the first intermediate storage body 121 to the sixth liquid flow path 156 in the first liquid flow path 151. The first check valve 181 regulates a flow of fluid from the sixth liquid flow path 156 and the second liquid flow path 152 to the first intermediate storage body 121.

The second check valve 182 allows a flow of fluid from the second intermediate storage body 122 to the sixth liquid flow path 156 in the second liquid flow path 152. The second check valve 182 regulates a flow of fluid from the sixth liquid flow path 156 and the first liquid flow path 151 to the second intermediate storage body 122.

The third check valve 183 allows a flow light fitting fluid from the liquid supply source 101 to the first intermediate storage body 121 in the third liquid flow path 153, and meanwhile regulates a flow of fluid from the first intermediate storage body 121 to the liquid supply source 101. That is, the third check valve 183 allows a flow of fluid from the fifth liquid flow path 155 to the first liquid flow path 151, and regulates a flow of fluid from the first liquid flow path 151 to the fifth liquid flow path 155.

The fourth check valve 184 allows a flow of fluid from the liquid supply source 101 to the second intermediate storage body 122 in the fourth liquid flow path 154, and meanwhile regulates a flow of fluid from the second intermediate storage body 122 to the liquid supply source 101. That is, the fourth check valve 184 allows a flow of fluid from the fifth liquid flow path 155 to the second liquid flow path 152, and regulates a flow of fluid from the second liquid flow path 152 to the fifth liquid flow path 155.

Accordingly, when the first pressure adjusting mechanism 141 depressurizes the inside of the first intermediate storage body 121, liquid accommodated in the liquid supply source 101 flows in the first intermediate storage body 121 through the fifth liquid flow path 155, the third liquid flow path 153, and the first liquid flow path 151. When the first pressure adjusting mechanism 141 pressurizes the inside of the first intermediate storage body 121, and liquid is consumed in the liquid ejecting unit 41, liquid stored in the first intermediate storage body 121 is supplied to the liquid ejecting unit 41 through the first liquid flow path 151 and the sixth liquid flow path 156.

When the second pressure adjusting mechanism 142 depressurizes the second intermediate storage body 122, liquid accommodated in the liquid supply source 101 flows in the second intermediate storage body 122 through the fifth liquid flow path 155, the fourth liquid flow path 154, and the second liquid flow path 152. When the second pressure adjusting mechanism 142 pressurizes the inside of the second intermediate storage body 122, and liquid is consumed in the liquid ejecting unit 41, liquid stored in the second intermediate storage body 122 is supplied to the liquid ejecting unit 41 through the second liquid flow path 152 and the sixth liquid flow path 156.

The fifth check valve 185 allows a flow of fluid from the first filter portion 210 to the connection portion 160, and meanwhile, regulates a flow of fluid from the connection portion 160 to the first filter portion 210. Accordingly, in the fluid flow path 158, a fluid flows from the first filter portion 210 to the connection portion 160. For this reason, in the fluid flow path 158, the first filter portion 210 side is referred to as an upstream side, and the connection portion 160 side is referred to as a downstream side.

The sixth check valve 186 allows a flow of fluid from the third filter portion 230 to the degassing mechanism 270, and meanwhile, regulates a flow of fluid from the degassing medium 270 to the third filter portion 230.

Subsequently, one embodiment of the first filter portion 210 to the fourth filter portion 240 will be described.

In the first filter portion 210 to the fourth filter portion 240, a collecting performance of foreign substances decreases along with an increase in use time. For this reason, The liquid ejecting apparatus 10 may exchange a part of at least one filter of the first filter portion 210 to the fourth filter portion 240. In this case, as illustrated in FIG. 2, it is preferable to provide a cover 18 in the housing 12, and provide a filter portion which can be exchanged at a position which is exposed from the housing 12 when the cover 18 is opened.

As illustrated in FIG. 3, the first filter portion 210, the second filter portion 220, and the fourth filter portion 240 configures a part of the liquid supply flow path 150 and the circulating flow path 157. The third filter portion 230 configures a part of the fluid flow path 158 and the circulating flow path 157.

The first filter portion 210 includes a first filter 211 which collect foreign substances, a first upstream side filter chamber 212 which becomes the upstream side of the first filter 211, and a first downstream side filter chamber 213 which becomes the downstream side of the first filter 211. The first upstream side filter chamber 212 is disposed at a vertically higher part of the first downstream side filter chamber 213. The first upstream side filter chamber 212 is formed in an appropriately conical shape or an approximately truncated cone shape, and the first filter 211 is formed in an approximately disk shape by configuring a lower face of the first upstream side filter chamber 212. It is preferable that a height of the first upstream side filter chamber 212 be smaller than a diameter of the first filter 211.

The second filter portion 220 is located on the upstream side of the first filter portion 210. The second filter portion 220 includes a second filter 221 which collects foreign substances, the second upstream side filter chamber 222 which is the upstream side of the second filter 221, and the second downstream side filter chamber 223 which is the downstream side of the second filter 221.

The third filter portion 230 includes the third filter 231 which collects foreign substances, the third upstream side filter chamber 232 which is the upstream side of the third filter 231, and the third downstream side filter chamber 233 which is the downstream side of the third filter 231.

The fourth filter portion 240 is located on the upstream side of the second filter portion 220. The fourth filter portion 240 includes the fourth filter 241 which collects foreign substances, the fourth upstream side filter chamber 242 which is the upstream side of the fourth filter 241, and the fourth downstream side filter chamber 243 which is the downstream side of the fourth filter 241.

The upstream side is a primary side before passing through the first filter 211 to the fourth filter 241, and the downstream side is a secondary side after passing through the first filter 211 to the fourth filter 241. In the first filter 211 to the fourth filter 241, it is preferable that a filtration area through which a fluid can pass be larger than flow path sectional areas of the liquid supply flow path 150 and the fluid flow path 158.

Subsequently, the other configuration which is provided in the sixth liquid flow path 156, the fluid flow path 158, and the discharging flow path 159 will be described.

The static mixer 250 is provided with a plurality of configurations which divide a flow of liquid in a direction in which the liquid flows. In addition, the static mixer 250 reduces bias of concentration in liquid by diving, turning, or reversing the liquid which flows in the static mixer 250.

The liquid storage unit 260 includes a pressurizing chamber 261 which stores liquid, an elastic film 262 which configures a part of a wall face of the pressurizing chamber 261, and a first urging member 263 which urges the elastic film 262 in a direction in which a volume of the pressurizing chamber 261 is reduced. In this manner, in the liquid storage unit 260, the pressurizing chamber 261 pressurizes liquid which is stored in the pressurizing chamber 261.

Here, the pressurizing chamber 261 pressurizes liquid which is stored in the pressurizing chamber 261 with a pressure (for example, 10 kPa) which is lower than a pressure with which the intermediate storage body 120 is pressurized (for example, 30 kPa) when supplying liquid to the liquid ejecting unit 41. Specifically, a pressure which is operated to liquid which is stored in the pressurizing chamber 261 using the elastic film 262 which is urged by the first urging member 263 becomes lower than a pressure which is operated to the intermediate storage body 120 by the pressure adjusting mechanism 140 in order to supply liquid from the intermediate storage body 120 toward the liquid ejecting unit 41. For this reason, in a case in which a supply pressure of liquid from the intermediate storage body 120 is not lowered to the liquid storage unit 260, the elastic film 262 is displaced in a direction in which the volume of the pressurizing chamber 261 increases against to an urging force of the first urging member 263.

Figure 4:
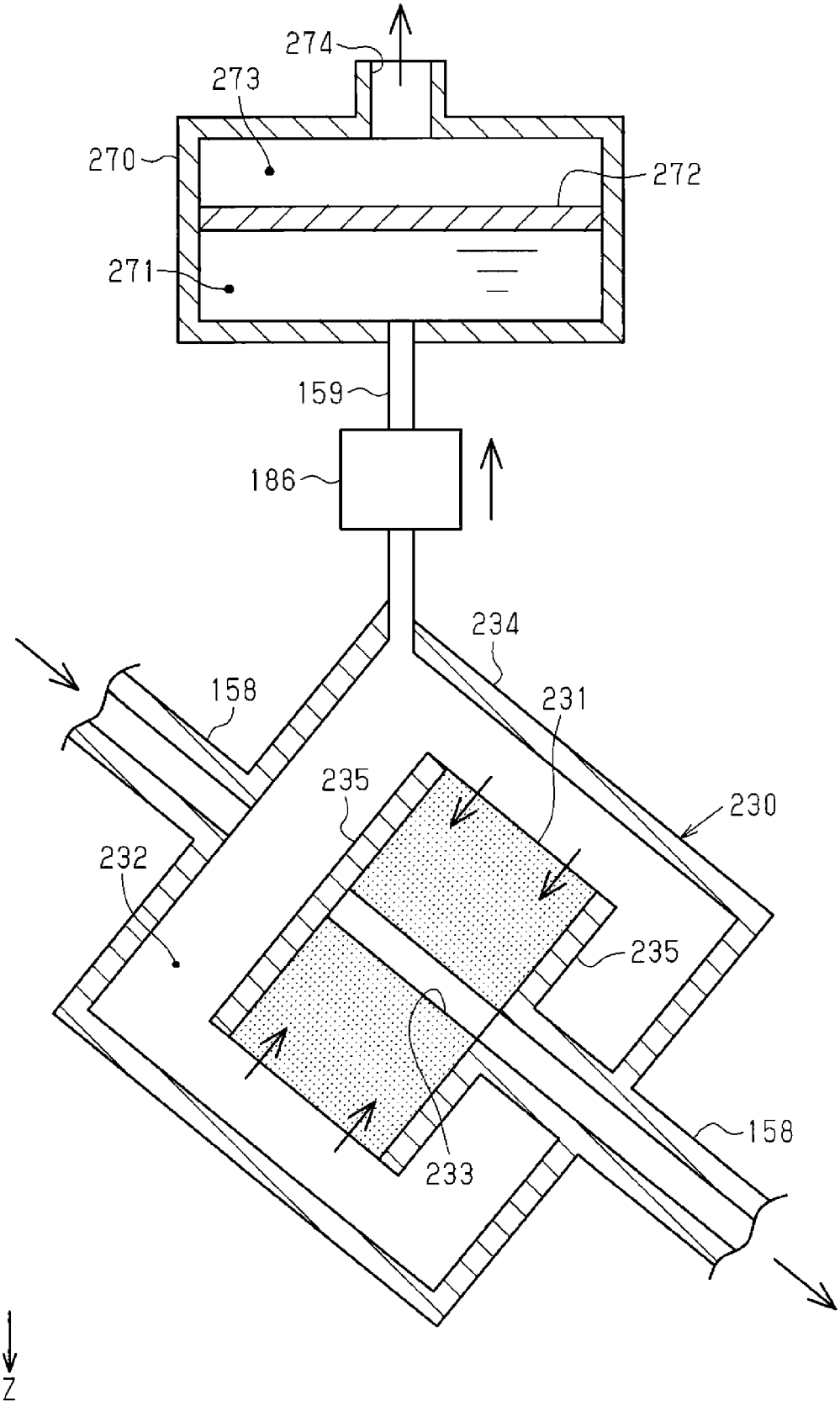
FIG. 4 is a schematic view of a third filter and a degassing mechanism.

As illustrated in FIGS. 3 and 4, the degassing mechanism 270 is provided with a degassing chamber 271 which temporarily stores liquid, a discharging chamber 273 which is partitioned into the degassing chamber 271 and a degassing film 272, and a discharging path 274 which causes the discharging chamber 273 to communicate with the outside.

Since the degassing mechanism 270 which is provided in the sixth liquid flow path 156, and the degassing mechanism 270 which is provided in the discharging flow path 159 have approximately the same configuration, redundant descriptions will be omitted by giving the same reference numerals in the same configuration. The degassing chamber 271 of the degassing mechanism 270 which is provided in the sixth liquid flow path 156 configures a part of the sixth liquid flow path 156, and the degassing chamber 271 of the degassing mechanism 270 which is provided in the discharging flow path 159 configures a downstream end of the discharging flow path 159.

The degassing film 272 has a property of allowing gas to pass through; however has a property of not allowing liquid to pass through. As the degassing film 272, for example, it is possible to adopt a material obtained by forming a plurality of fine holes of approximately 0.2 micron in a film which is manufactured by performing special stretching processing with respect to polytetrafluoroethylene (PTFE). When liquid includes gas flows in the degassing chamber 271, only gas enters the discharging chamber 273 by passing through the degassing film 272, and is discharged to the outside through the discharging path 274. In this manner, bubbles or dissolved gas which are mixed into liquid which is stored in the degassing chamber 271 are removed while suppressing discharging of liquid from the discharging flow path 159.

In the degassing mechanism 270, the discharging chamber 273 is disposed at a vertically higher part of the degassing chamber 271. The degassing mechanism 270 may be provided with the depressurizing pump 275 which depressurizes the discharging chamber 273. The depressurizing pump 275 removes bubbles or dissolved gas which is mixed into liquid which is stored in the degassing chamber 271 by depressurizing the discharging chamber 273 through the discharging path 274. For example, in a case in which it is possible to make a pressure of the discharging chamber 273 lower than that of the degassing chamber 271 by using an urging member such as a spring, the depressurizing pump 275 may not be provided.

As illustrated in FIG. 3, the liquid pressure adjusting mechanism 280 is provided at a position on the downstream side of a second filter portion 220 integrally with the second filter portion 220. The liquid pressure adjusting mechanism 280 is provided with a pressure chamber 282 which can communicate with the second downstream side filter chamber 223 through a communicating hole 281, a valve 283 which can open or close the communicating hole 281, and a pressure receiving member 284 of which a base end side is accommodated in the second downstream side filter chamber 223, and a tip end side is accommodated in the pressure chamber 282.

The pressure chamber 282 can store liquid. A part of a wall face of the pressure chamber 282 is formed, using a flexible wall 285 which can perform bending displacement. The valve 283 may be an elastic body such as rubber or a resin which is attached to a base end portion of the pressure receiving member 284 which is located in the second downstream side filter chamber 223.

The liquid pressure adjusting mechanism 280 is provided with a second urging member 286 which is accommodated in the second downstream side filter chamber 223, and a third urging member 287 which is accommodated in the pressure chamber 282. The second urging member 286 urges the valve 283 in a direction of blocking the communicating hole 281 through the pressure receiving member 284. The third urging member 287 pushes back the pressure receiving member 284 when a flexible wall 285 pushes the pressure receiving member 284, when the flexible wall 285 performs bending displacement in a direction of reducing a volume of the pressure chamber 282.

For this reason, in a case in which an inner pressure of the pressure chamber 282 decreases, and a pushing force of the flexible wall 285 with respect to the pressure receiving member 284 exceeds urging forces of the second urging member 286 and height third urging member 287, the valve 283 opens the communicating hole 281. When the communicating hole 281 is opened, and liquid flows in the pressure chamber 282 from the second downstream side filter chamber 223, an inner pressure of the pressure chamber 282 increases. As a result, the valve 283 blocks the communicating hole 281 using an urging force of the third urging member 287, before the inner pressure of the pressure chamber 282 increases to a positive pressure. In this manner, the inner pressure of the pressure chamber 282 is held to a range of a negative pressure corresponding to the urging force of the third urging member 287. In addition, the inner pressure of the pressure chamber 282 decreases along with discharging of liquid from the liquid ejecting unit 41. In addition, the valve 283 autonomously closes the communicating hole 281 corresponding to a pressure difference between an external pressure (atmospheric pressure) of the pressure chamber 282 and the inner pressure of the pressure chamber 282. For this reason, the liquid pressure adjusting mechanism 280 is also referred to as a differential pressure valve (depressurizing valve or self-sealing valve).

A valve opening mechanism 290 which supplies liquid to the liquid ejecting unit 41 by forcibly opening the communicating hole 281 may be added to the liquid pressure adjusting mechanism 280. For example, the valve opening mechanism 290 is provided with a pressurizing bag 292 which is accommodated in the accommodating chamber 291 which is partitioned from the pressure chamber 282 by the flexible wall 285, and a pressurizing flow path 293 which causes gas to flow into the pressurizing bag 292.

The valve opening mechanism 290 forcibly opens the communicating hole 281 when the pressurizing bag 292 expands due to gas which flows in through the pressurizing flow path 293, and when causing the flexible wall 285 to be displaced in a bending manner in a direction in which a volume of the pressure chamber 282 is reduced. The liquid supply device 100 can perform pressurizing cleaning in which liquid is caused to flow out from the liquid ejecting unit 41 by supplying liquid from the liquid supply source 101 to the liquid ejecting unit 41 in a pressurizing manner, in a state in which the communicating hole 281 is opened.

In this case, the pressurizing flow path 293 is connected to the discharging path 274, and the depressurizing pump 275 may be configured so as to perform both driving of pressurizing and depressurizing. That is, gas may be sent out to the pressurizing bag 292 when the discharging path 274 is provided with a seventh check valve 187, then the depressurizing pump 275 performs pressurizing driving, and the discharging chamber 273 may be depressurized when the depressurizing pump 275 performs depressurizing driving.

The circulating pump 190 causes liquid to flow from the first upstream side filter chamber 212 toward the connection portion 160. When the circulating pump 190 is driven, liquid circulates in the circulating flow path 157, and foreign substances such as bubbles which are included in liquid are collected in the first filter 211 to the fourth filter 241. In addition, in a case in which liquid contains a precipitating component such as a pigment, it is possible to suppress ununiformity of concentration by agitating liquid by causing the liquid to circulate, or to pass through the static mixer 250.

Subsequently, one embodiment of the third filter portion 230 will be described.

As illustrated in FIG. 4, the third filter portion 230 is provided with a cylindrical filter case 234, and a cylindrical third filter 231 is disposed in the filter case 234 so that a center axis of the cylindrical third filter 231 is overlapped with the filter case 234. The lower face portion of the third filter 231 and a top face portion are blocked by a disk-shaped support plate 235.

The third upstream side filter chamber 232 is a space which is formed in a surrounding manner between the filter case 234 and the third filter 231, and the third downstream side filter chamber 233 is a space which is formed in a surrounding manner in the support plate 235 and the third filter 231 inside the third filter 231.

The fluid flow path 158 is connected to the third upstream side filter chamber 232 from a circular top face of the filter case 234 which is formed in a cylindrical shape, and is connected to the third downstream side filter chamber 233 by penetrating the lower face, and the support plate 235 on the lower face side.

The third filter portion 230 may be disposed by being inclined so that the primary side (upstream side) becomes higher than the secondary side (downstream side). In addition, the discharging flow path 159 may be connected to the higher end portion of the third upstream side filter chamber 232 in the vertical direction. By doing that, since gas which enters the third upstream side filter chamber 232 gathers at a corner portion as the highest position in the third upstream side filter chamber 232, gas easily enters the discharging flow path 159 rather than liquid.

When a fluid enters the third filter portion 230, the fluid is temporarily stored in the third upstream side filter chamber 232, enters the inside of the third filter 231 from the outer peripheral face of the third filter 231 thereafter, and reaches the third downstream side filter chamber 233. At this time, foreign substances including bubbles are collected in the third filter 231. In addition, the air bubbles which are collected in the third filter 231 gather at the higher part of the third upstream side filter chamber 232, and flow out to the outside from the discharging flow path 159. In addition, liquid of which foreign substances are filtered by the third filter 231 moves to the third downstream side filter chamber 233. In addition, in the configuration illustrated in FIG. 4, a direction in which a fluid flows is denoted by an arrow.

Subsequently, one embodiment of the first filter 211 to the fourth filter 241, and a size of foreign substances which can be collected by the first filter 211 to the fourth filter 241 will be described.

It is possible to use a meshed body, a porous body, a porous plate in which a fine through hole is formed, or the like, for example, in the first filter 211 to the fourth filter 241. In the first filter 211 to the fourth filter 241, filters of different types, and of different shapes may be used, respectively.

As a filter of the meshed body, there is a metal mesh, a resin mesh, a mesh filter, a metallic fiber, or the like. As a filter of the metallic fiber, there is a felt filter in which a stainless steel thin line is formed in a felt shape, a metallic sintered filter in which a stainless steel thin line is sintered in a compressing manner, or the like. As the filter of the porous plate, there is an electroforming metallic filter, an electron beam processing metallic filter, a laser beam processing metallic filter, or the like.

Figure 5:
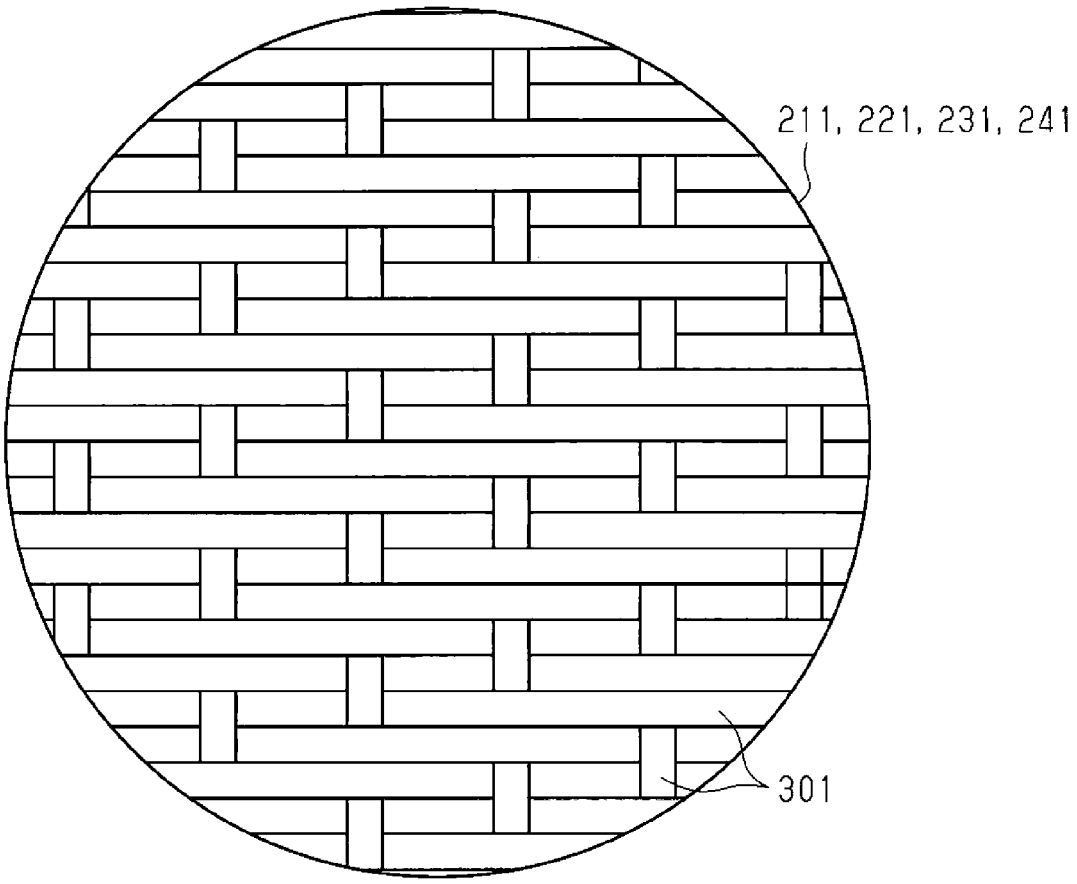
FIG. 5 is a schematic view of a mesh filter.
Figure 6:
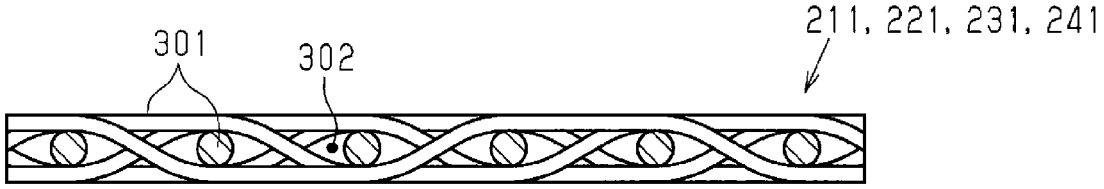
FIG. 6 is a schematic sectional view of the mesh filter.
Figure 7:
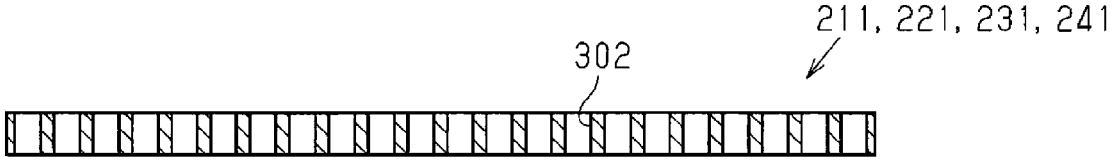
FIG. 7 is a schematic sectional view of a filter of a porous plate.

As illustrated in FIGS. 5 to 7, the first filter 211 to the fourth filter 241 are provided with a plurality of holes 302 through which a fluid can pass through, and collect foreign substances. In the embodiment, an ability of collecting foreign substances of a filter is denoted by a filtration grain size. The filtration grain size is a nominal filtration grain size which can be collected with a certain probability, and is a value measured according to the ISO4572 standard. For example, when the filtration grain size is 5 μm, it denotes that 98.5% of a particle having an average diameter of 5 μm can be collected.

It is preferable that a filtration grain size which denotes a size of foreign substances which can be collected by the first filter 211 to the fourth filter 241 be smaller than the minimum size of the nozzle opening 44 (for example, 20 μm (0.020 mm)). By doing that, it is possible to make foreign substances in liquid difficult to reach the nozzle opening 44. In a case in which the nozzle opening 44 is circular, the minimum size of the nozzle opening 44 is a diameter of the nozzle opening 44. The nozzle opening 44 is not limited to a circular shape, and may be a polygonal shape, an oval shape, a fan shape, and a combination of these shapes.

It is preferable that a size of foreign substances which are collected by the second filter 221 be larger than that which can be collected by the first filter 211. That is, for example, in a case in which a filtration grain size of the first filter 211 is 5 μm, it is preferable that the second filter 221 be a filtration grain size of 10 μm which is larger than that of the first filter 211.

As illustrated in FIGS. 5 and 6, the first filter 211 to the fourth filter 241 can be set to a filter of twill-mat weaving in a case of adopting a mesh filter. In the mesh filter which is formed by weaving a stainless steel wire 301, a mesh as a gap (not illustrated) between wires 301 in FIG. 5, and a mesh as a gap between wires 301 in FIG. 6 are provided. That is, according to the embodiment, the upstream side filter chamber and the downstream side filter chamber are caused to communicate, and a mesh as a gap between the wires 301 which are continuous so as to penetrate the filter is referred to as a hole 302.

As illustrated in FIG. 7, in a case of adopting a filter of a porous plate as the first filter 211 to the fourth filter 241, it is preferable that a minimum size of the hole 302 be smaller than that of the nozzle opening 44. A plurality of (for example, tens of thousands holes in 1 $cm^2$) the holes 302 which penetrate the stainless steel plate are formed in the filter of the porous plate. The minimum size of the hole 302 is a diameter (inner diameter) of the hole 302 in a case in which the hole 302 is circular. A shape of the hole 302 may be a square, a polygon such as a hexagon, an oval shape, or the like, without being limited to a circular shape.

Subsequently, an electrical configuration of the liquid ejecting apparatus 10 will be described.

The first flow rate sensor 171 and the second flow rate sensor 172 are connected to an input side interface of the control unit 60. In addition, the transport unit 30, the actuator 414, the maintenance unit 50, the pressure adjusting pump 144, the first on-off valve 161 to the third on-off valve 163, the depressurizing pump 275, and the circulating pump 190 are connected to an output side interface of the control unit 60.

The control unit 60 calculates an amount of liquid stored in the intermediate storage body 120 based on a detecting result of the flow rate sensors 171 and 172. Specifically, in a case in which liquid flows in the intermediate storage body 120, the control unit 60 adds an amount of liquid corresponding to a time in which the liquid flows in, and a flow rate thereof to an amount of liquid stored in the intermediate storage body 120, based on the detecting result of the flow rate sensors 171 and 172. On the other hand, in a case in which liquid flows out from the intermediate storage body 120, the control unit 60 subtracts an amount of liquid corresponding to a time in which the liquid flows out, and a flow rate thereof from the amount of liquid stored in the intermediate storage body 120 based on the detecting result of the flow rate sensors 171 and 172. In this manner, the control unit 60 grasps the amount of liquid stored in the intermediate storage body 120. In a case in which the flow rate sensors 171 and 172 cannot distinguish a direction in which the liquid flows, the control unit 60 may determine the direction in which the liquid flows in accordance with state of driving of the pressure adjusting mechanism 140.

Subsequently, a filling method of the liquid ejecting apparatus 10 will be described.

Before starting a use of the liquid ejecting apparatus 10, a filling operation of filling liquid in the liquid supply source 101 into the liquid supply flow path 150 in a state of not being filled with the liquid is performed. That is, since gas enters a region from the liquid supply flow path 150 to the nozzle opening 44 which leads to the liquid supply source 101, in the filling operation, liquid is filled by discharging the gas.

As illustrated in FIG. 3, the control unit 60 depressurizes the inside of the first intermediate storage body 121, and causes liquid accommodated in the liquid supply source 101 to be supplied toward the first intermediate storage body 121. In this manner, a fluid (mainly gas) in the first liquid flow path 151, the third liquid flow path 153, and the fifth liquid flow path 155 flows into the first intermediate storage body 121.

When a volume of the liquid accommodating unit 123 provided in the first intermediate storage body 121 become maximum, the control unit 60 pressurizes the inside of the first intermediate storage body 121, and depressurizes the inside of the second intermediate storage body 122. When the inside of the first intermediate storage body 121 is pressurized, a fluid accommodated in the first intermediate storage body 121 is supplied toward the sixth liquid flow path 156, and gas is discharged due to the degassing mechanism 270 which is provided in the sixth liquid flow path 156. When the second intermediate storage body 122 is depressurized, a fluid (mainly gas) in the second liquid flow path 152, the fourth liquid flow path 154, and the fifth liquid flow path 155 flows into the second intermediate storage body 122.

When a volume of the liquid accommodating unit 123 provided in the first intermediate storage body 121 become minimum, and a volume of the liquid accommodating unit 123 provided in the second intermediate storage body 122 becomes maximum, the control unit 60 depressurizes the inside of the first intermediate storage body 121, and pressurizes the inside of the second intermediate storage body 122. When the inside of the second intermediate storage body 122 is pressurized, a fluid accommodated in the second intermediate storage body 122 is supplied toward the sixth liquid flow path 156, and gas is discharged due to the degassing mechanism 270 which is provided in the sixth liquid flow path 156.

In this manner, the control unit 60 alternated repeats pressurizing the inside of the first intermediate storage body 121 and depressurizing the inside of the second intermediate storage body 122, and depressurizing the inside of the first intermediate storage body 121 and pressurizing the inside of the second intermediate storage body 122. In this manner, the first intermediate storage body 121, the second intermediate storage body 122, the first liquid flow path 151 to the fifth liquid flow path 155, and a part of the sixth liquid flow path 156 are filled with liquid.

Thereafter, the control unit 60 drives the suctioning pump 52 for a predetermined time in a state in which the liquid ejecting unit 41 is capped, and pressurizes at least one of the intermediate storage body 120 of the first intermediate storage body 121 and the second intermediate storage body 122. That is, the control unit 60 causes a pressure to be operated so that a pressure on the downstream side becomes lower than that on the upstream side, in the liquid supply flow path 150. Then, liquid is supplied from the pressurized intermediate storage body 120, and a fluid (mainly gas) in the liquid supply flow path 150 is discharged from the nozzle opening 44 of the liquid ejecting unit 41.

Figure 8:
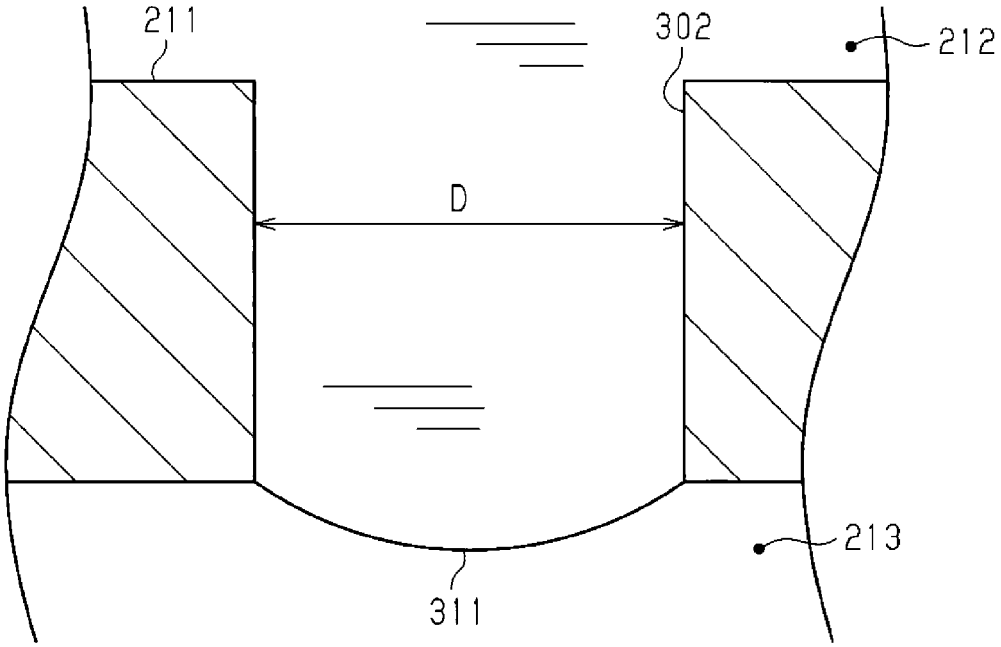
FIG. 8 is a schematic view of a first gas-liquid interface which is formed in a hole of a first filter.

As illustrated in FIG. 8, specifically, when liquid is supplied to the first filter portion 210, the upstream side of the first filter 211 becomes liquid, and the downstream side of the first filter 211 becomes gas, and a first gas-liquid interface 311 is formed in the hole 302 of the first filter 211. The first gas-liquid interface 311 is destroyed when a pressure difference between the first upstream side filter chamber 212 and the first downstream side filter chamber 213 becomes a first pressure difference ΔPA or more, and liquid is filled in the liquid supply flow path 150.

Figure 9:
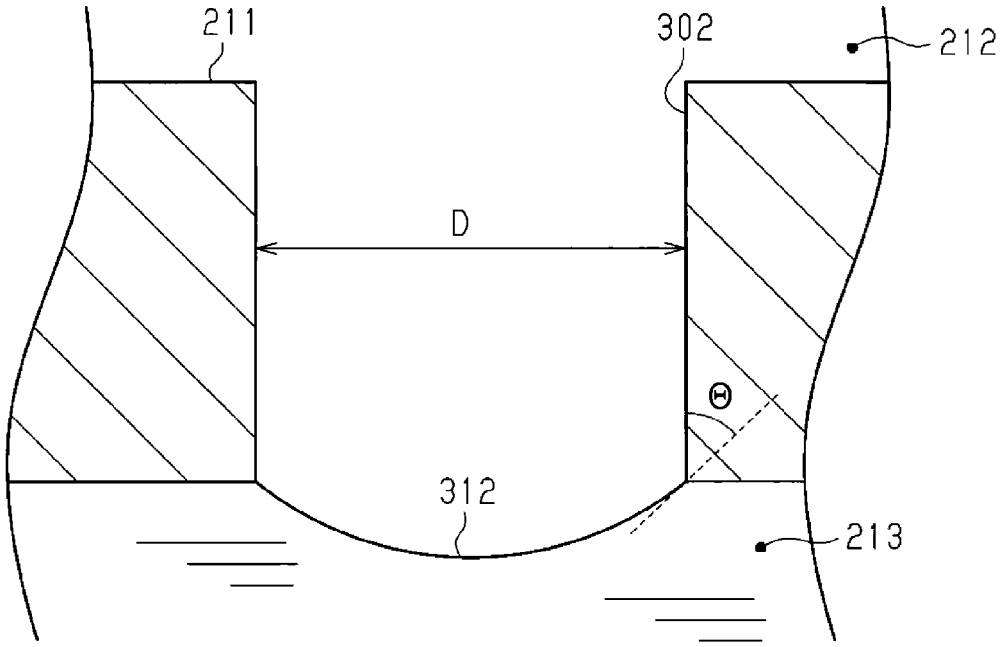
FIG. 9 is a schematic view of a second gas-liquid interface which is formed in the hole of the first filter.

As illustrated in FIG. 9, in a case in which gas (air bubbles) is included in liquid, the gas is collected by the first filter 211. At this time, the upstream side of the first filter 211 becomes gas, and the downstream side of the first filter 211 becomes liquid, and a second gas-liquid interface 312 is formed in the hole 302 of the first filter 211. The second gas-liquid interface 312 is destroyed when a pressure difference between the first upstream side filter chamber 212 and the first downstream side filter chamber 213 becomes a second pressure difference ΔPB or more. The second pressure difference ΔPB is larger than the first pressure difference ΔPA (ΔPA<ΔPB).

The control unit 60 drives the suctioning pump 52 and the pressure adjusting mechanism 140 so that a maximum pressure difference which occurs between the first upstream side filter chamber 212 and the first downstream side filter chamber 213 is larger than the first pressure difference ΔPA, and is smaller than the second pressure difference ΔPB in the filling operation. For this reason, liquid passes through the first filter 211; however, in contrast to this, foreign substances (gas) which are larger than the hole 302 is collected without passing through the first filter 211. When the liquid supply flow path 150 is filled with liquid, the control unit 60 stops driving of the suctioning pump 52.

In this stage, gas still remains in the fluid flow path 158. Subsequently, the control unit 60 performs a discharging operation in which a fluid in the first upstream side filter chamber 212 is discharged to the outside of the first upstream side filter chamber 212. That is, the control unit 60 drives the circulating pump 190 for a predetermined time in a state of releasing capping, and moves the fluid from the first upstream side filter chamber 212 to the fluid flow path 158. A part of the fluid (mainly gas) in the fluid flow path 158 is discharged through the discharging flow path 159, and a part moves from the connection portion 160 to the liquid supply flow path 150. In the fluid, gas is discharged by the two degassing mechanisms 270 while moving in the circulating flow path 157, and liquid is also filled in the fluid flow path 158.

In the discharging operation, a pressure which is operated in the first upstream side filter chamber 212 is also operated on the downstream side of the first upstream side filter chamber 212 in the liquid supply flow path 150. For this reason, a pressure which is operated in the liquid supply flow path 150 on the nozzle opening 44 side of the first filter portion 210 becomes lower than a pressure in the space to which the nozzle opening 44 is open.

Figure 10:
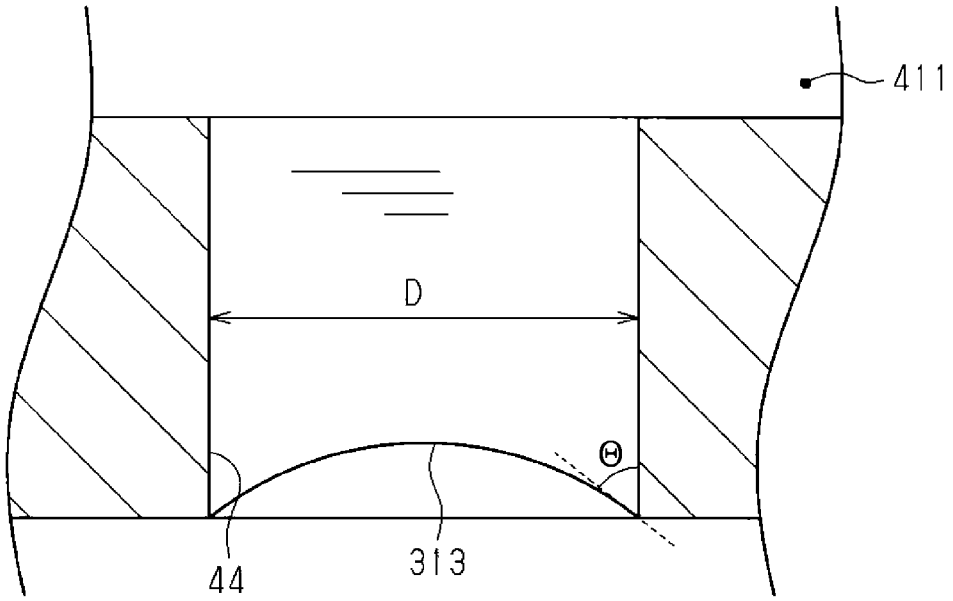
FIG. 10 is a schematic view of a third gas-liquid interface which is formed in a nozzle opening.

As illustrated in FIG. 10, a third gas-liquid interface 313 is formed in the nozzle opening 44. In the discharging operation, the control unit 60 drives the circulating pump 190 so that a maximum pressure difference which occurs between the upstream side of the third gas-liquid interface 313 and the space side becomes smaller than a third pressure difference ΔPC which destroys the third gas-liquid interface 313.

Subsequently, the third pressure difference ΔPC which destroys the third gas-liquid interface 313 will be described.

As illustrated in FIG. 10, a surface tension of liquid is set to γ, a wetting angle is set to Θ, and a diameter of the nozzle opening 44 in which the third gas-liquid interface 313 is formed is set to D.

In a case in which the nozzle opening 44 is circular, a pressure Pγ which occurs due to an interface tension between the liquid surface and the nozzle opening 44 becomes $P\gamma=4\gamma \cos \Theta D\pi/(\pi D^2)=4\gamma \cos \Theta/D$.

A water head pressure Ph of liquid in a case in which density of liquid is set to p, a depth is set to h, and a gravitational acceleration is set to g is set to $Ph=\rho hg$.

The pressure difference ΔP which destroys the gas-liquid interface is balanced with the pressure Pγ, and the water head pressure Ph, and it becomes $\Delta P=P\gamma+Ph$. Since Ph is approximately zero, it becomes $\Delta P=P\gamma=4\gamma \cos \Theta/D$.

For example, in a case in which the diameter D of the nozzle opening 44 is 20 μm, and the surface tension γ of liquid is 23.6 mN/m, when setting the wetting angle to Θ≈0, it becomes ΔPC≈4.7 kPa. That is, the third gas-liquid interface 313 which is formed in the nozzle opening 44 has a high possibility of being destroyed when a pressure difference between the upstream side image forming the third gas-liquid interface 313 and the space side becomes approximately 4.7 kPa or more. Accordingly, the control unit 60 drives the circulating pump 190 so that the pressure difference between the upstream side image forming the third gas-liquid interface 313 and the space side becomes 4.7 kPa or less.

The first pressure difference ΔPA and the second pressure difference ΔPB are changed due to a type, a material, a filtration grain size, or the like, of the first filter 211. In addition, the first pressure difference ΔPA and the second pressure difference ΔPB are also changed due to the surface tension of liquid.

In FIG. 11, the second pressure difference ΔPB in which the second gas-liquid interface 312 is destroyed is measured by changing a combination of a stainless steel mesh filter and liquid, and a case in which the second gas-liquid interface 312 is not destroyed is denoted by o, and a case in which the second gas-liquid interface 312 is destroyed is denoted by x. In addition, the mesh in FIG. 11 is a unit which denotes an aperture of a mesh of a mesh filter, and when the mesh is 2300, it means that it is a mesh filter in which the number of meshes (gaps between wires 301) per 1 inch is 2300.

No. 1 is a combination of a stainless steel mash filter of twill mat weaving (mesh 2300) and liquid with a surface tension of 23.6 mN/m. In the combination, the second gas-liquid interface 312 is not destroyed, when a pressure difference between the first upstream side filter chamber 212 and the first downstream side filter chamber 213 is 10 kPa, and the second gas-liquid interface 312 is destroyed when the pressure difference is 20 kPa. That is, the second pressure difference ΔPB is larger than 10 kPa, and is 20 kPa or less (10 kPa<ΔPB≤20 kPa). For this reason, in the filling operation, it is preferable that the control unit 60 drive the suctioning pump 52 and the pressure adjusting mechanism 140 so that a maximum pressure difference which occurs between the first upstream side filter chamber 212 and the second downstream side filter chamber 223 becomes smaller than the second pressure difference ΔPB which is assumed to be larger than 10 kPa, and is 20 kPa or less. In addition, from an evaluation result, it is more preferable to set a maximum pressure difference which occurs between the first upstream side filter chamber 212 and the second downstream side filter chamber 223 to be 10 kPa or less, in the filling operation.

The mesh as a gap between the wires 301 as the hole 302 of the stainless steel mesh filter of twill mat weaving, has a complicated shape. For this reason, it is difficult to obtain the second pressure difference ΔPB using a calculation formula from the specification; however it is assumed that the stainless steel mesh filter of twill mat weaving (mesh 2300) is a filter of a porous plate on which the hole 302 with a diameter of filtration grain size 10 μm is formed. When obtaining the second pressure difference ΔPB from a calculation formula which obtains the pressure difference ΔP which destroys the above described gas-liquid interface, it becomes ΔPB≈9.4 kPa, and becomes a value smaller than the second pressure difference ΔPB which is assumed from the evaluation result.

No. 2 is a combination of a stainless steel mesh filter of twill mat weaving (mesh 2800) and liquid of which a surface tension is 23.6 mN/m. In the combination, the second gas-liquid interface 312 is not destroyed when a pressure difference between the first upstream side filter chamber 212 and the second downstream side filter chamber 223 is 20 kPa, and is destroyed when the pressure difference is 30 kPa. That is, the second pressure difference ΔPB is larger than 20 kPa, and is 30 kPa or less (20 kPa<ΔPB≤30 kPa). For this reason, in the filling operation, it is preferable that the control unit 60 drive the suctioning pump 52 and the pressure adjusting mechanism 140 so that a maximum pressure difference which occurs between the first upstream side filter chamber 212 and the second downstream side filter chamber 223 becomes smaller than the second pressure difference ΔPB which is assumed to be larger than 20 kPa, and is 30 kPa or less. In addition, in the filling operation, it is more preferable to set the maximum pressure difference which occurs between the first upstream side filter chamber 212 and the second downstream side filter chamber 223 to be 20 kPa or less from the evaluation result.

When obtaining the second pressure difference ΔPB from the calculation formula which obtains the pressure difference ΔP which destroys the above described gas-liquid interface, by assuming that the stainless steel mesh filter of twill mat weaving (mesh 2800) as the filter of the porous plate on which hole 302 with a diameter of a nominal filtration grain size of 5 μm is formed, it becomes ΔPB≈18.9 kPa, and becomes a value smaller than the second pressure difference ΔPB which is assumed from the evaluation result.

No. 3 is a combination of a stainless steel mesh filter of twill mat weaving (mesh 3600) and liquid of which a surface tension is 23.6 mN/m. In the combination, the second gas-liquid interface 312 is not destroyed when a pressure difference between the first upstream side filter chamber 212 and the second downstream side filter chamber 223 is 30 kPa, and the second gas-liquid interface 312 is destroyed when the pressure difference is 40 kPa. That is, the second pressure difference ΔPB is larger than 30 kPa, and is 40 kPa or less (30 kPa<ΔPB≤40 kPa). For this reason, in the filling operation, it is preferable that the control unit 60 drive the suctioning pump 52 and the pressure adjusting mechanism 140 so that a maximum pressure difference which occurs between the first upstream side filter chamber 212 and the second downstream side filter chamber 223 becomes smaller than the second pressure difference ΔPB which is assumed to be larger than 30 kPa, and is 40 kPa or less. In addition, for this reason, in the filling operation, it is more preferable to set the maximum pressure difference which occurs between the first upstream side filter chamber 212 and the second downstream side filter chamber 223 to 30 kPa or less.

It is assumed that the stainless steel mesh filter of twill mat weaving (mesh 3600) is a filter of a porous plate on which the hole 302 with a diameter of a nominal filtration grain size 4 μm is formed. When obtaining the second pressure difference ΔPB from the calculation formula for obtaining the pressure difference ΔP which destroys the above described gas-liquid interface, it becomes ΔPB≈23.6 kPa, and it becomes a value smaller than the second pressure difference ΔPB which is assumed from the evaluation result.

No. 4 is a combination of the stainless steel mesh filter (mesh 2800) of twill mat weaving and liquid of which a surface tension is 58.6 mN/m. In the combination, the second gas-liquid interface 312 is not destroyed when the pressure difference between the first upstream side filter chamber 212 and the second downstream side filter chamber 223 is 50 kPa, and is destroyed when the pressure difference is 60 kPa. That is, the second pressure difference ΔPB is larger than 50 kPa, and is 60 kPa or less (50 kPa<ΔPB≤60 kPa). For this reason, in the filling operation, it is preferable that the control unit 60 drive the suctioning pump 52 and the pressure adjusting mechanism 140 so that a maximum pressure difference which occurs between the first upstream side filter chamber 212 and the second downstream side filter chamber 223 becomes smaller than the second pressure difference ΔPB which is assumed to be larger than 50 kPa, and is 60 kPa or less. In addition, for this reason, in the filling operation, it is more preferable to set the maximum pressure difference which occurs between the first upstream side filter chamber 212 and the second downstream side filter chamber 223 to 50 kPa or less.

When obtaining the second pressure difference ΔPB from the calculation formula for obtaining the pressure difference ΔP which destroys the above described gas-liquid interface by assuming that a stainless steel mesh filter of twill mat weaving (mesh 2800) as a filter of the porous plate on which the hole 302 with a diameter of a nominal filtration grain size of 5 μm is formed, it becomes ΔPB≈46.9 kPa, and becomes a value smaller than the second pressure difference ΔPB which is assumed from the evaluation result.

Subsequently, an operation of the liquid ejecting apparatus 10 which is configured as described above will be described.

When liquid is consumed in the liquid ejecting unit 41, liquid accommodated in the liquid supply source 101 is supplied to the liquid ejecting unit 41 by passing through the fourth filter portion 240, the second filter portion 220, and the first filter portion 210. Foreign substances such as air bubbles contained in liquid are collected in the fourth filter 241, the second filter 221, and the first filter 211.

Gas collected by the second filter 221 is discharged to the outside by the degassing mechanism 270 which is provided in the sixth liquid flow path 156. It is preferable that the degassing mechanism 270 be located at the vertically higher part of the second upstream side filter chamber 222. Due to this, air bubbles in the second upstream side filter chamber 222 are moved to the degassing mechanism 270, and can be degassed.

Gas collected by the first filter 211 is discharged from the first upstream side filter chamber 212 to the fluid flow path 158 by driving the circulating pump 190. The gas is discharged to the outside by the degassing mechanism 270 after being collected by the third filter portion 230.

The maintenance unit 50 regularly performs maintenance of the liquid ejecting unit 41. In suctioning cleaning and pressurizing cleaning, the control unit 60 drives the suctioning pump 52 or the pressure adjusting mechanism 140 so that a pressure difference between the first upstream side filter chamber 212 and the second upstream side filter chamber 222 becomes the first pressure difference ΔPA or less, and less than the second pressure difference ΔPB. In choke cleaning, the control unit 60 drives the suctioning pump 52 so that a pressure difference between the first upstream side filter chamber 212 after opening the third on-off valve 163 and the second upstream side filter chamber 222 becomes the first pressure difference ΔPA or more, and less than the second pressure difference ΔPB.

According to the above described embodiment, it is possible to obtain the following effects.

(1) In the filling operation, the maximum pressure difference which occurs between the first upstream side filter chamber 212 and the first downstream side filter chamber 213 is larger than a pressure difference for destroying the first gas-liquid interface 311 which is formed in the hole 302 of the first filter 211 in a case in which the upstream side of the first filter 211 is liquid, and the downstream side is gas. For this reason, liquid supplied from the liquid supply source 101 passes through the first filter 211. In addition, in the filling operation, the maximum pressure difference which occurs between the first upstream side filter chamber 212 and the first downstream side filter chamber 213 is smaller than a pressure difference for destroying the second gas-liquid interface 312 which is formed in the hole 302 of the first filter 211 in a case in which the upstream side of the first filter 211 is gas, and the downstream side is liquid. For this reason, also in a case in which gas gathers in the first upstream side filter chamber 212, the gas becomes air bubbles, and passes through the first filter 211, therefore, it is possible to reduce a concern of moving to the downstream side. Accordingly, even in a case in which the first filter 211 is provided in the liquid supply flow path 150, the liquid supply flow path 150 can be properly filled with liquid.

(2) Foreign substances which are larger than a size of the nozzle opening 44 can be collected by the first filter 211. Accordingly, it is possible to reduce a concern in which foreign substances which are unable to pass through the nozzle opening 44 flow to the nozzle opening 44 side.

(3) Foreign substances which are larger than a size of the nozzle opening 44 is collected by the second filter 221. Accordingly, it is possible to reduce a concern that foreign substances which are unable to pass through the nozzle opening 44 may flow to the nozzle opening 44 side. In addition, since the second filter 221 in which a size of foreign substances which can be collected is larger than the first filter 211 is provided on the upstream side of the first filter 211, it is possible to reduce foreign substances which are collected by the first filter 211, and reduce a concern that the first filter 211 may be clogged.

(4) In a case in which gas gathers in the first upstream side filter chamber 212 in which liquid is filled, it is possible to discharge a fluid containing gas to the outside of the first upstream side filter chamber 212 using the fluid flow path 158. Accordingly, it is possible to discharge gas (air bubbles) which gathers in the first upstream side filter chamber 212 to the outside, without causing the gas to pass through the liquid ejecting unit 41 so as not to pass through the first filter 211.

(5) For example, when a fluid is suctioned from the fluid flow path 158 side, and is discharged to the outside of the first upstream side filter chamber 212, a pressure which is operated in the liquid supply flow path 150 becomes lower than an air pressure in a space to which the nozzle opening 44 opens. In that point, a maximum pressure difference which occurs between the upstream side of the third gas-liquid interface 313 in which the nozzle opening 44 is formed and the space side to which the nozzle opening 44 is open is smaller than the third pressure difference ΔPC which destroys the third gas-liquid interface 313 which is formed in the nozzle opening 44. For this reason, it is possible to reduce a concern that the third gas-liquid interface 313 which is formed in the nozzle opening 44 is destroyed due to a discharging operation, and to reduce a concern that gas may flow in from the nozzle opening 44.

(6) The circulating flow path 157 is formed by the fluid flow path 158 in which a fluid in the first upstream side filter chamber 212 can be discharged to the outside of the first upstream side filter chamber 212, and the discharging flow path 159 is connected to the third filter portion 230 which configures a part of the circulating flow path 157. Accordingly, the configuration can be preferably adopted as a configuration in which gas discharged from the first upstream side filter chamber 212 is discharged to the outside of the liquid supply flow path 150 and the fluid flow path 158.

The above described embodiment may be modified like the following modification example. The above described embodiment and the following modification example may be combined in a predetermined manner.

The liquid supply device 100 may have a configuration in which at least one of the first intermediate storage body 121 and the second intermediate storage body 122 is not provided.

In the filling operation, the control unit 60 may perform any one of depressurizing using the suctioning pump 52 and pressurizing of the intermediate storage body 120 using the pressure adjusting mechanism 140, and the liquid supply flow path 150 may be filled with liquid.

The liquid ejecting apparatus 10 may have a configuration in which a filter portion of at least one of the first filter portion 210 to the fourth filter portion 240 is provided. That is, for example, the liquid ejecting apparatus 10 may have a configuration in which the third filter portion 230 is not provided. The liquid ejecting apparatus 10 may have a configuration in which the second filter portion 220 is not provided. In a case in which the liquid ejecting apparatus 10 is not provided with the first filter portion 210, for example, the second filter portion 220 functions as the first filter portion, and the fourth filter portion 240 functions as the second filter portion.

The third filter portion 230 may be provided in the sixth liquid flow path 156. The discharging flow path 159 is connected to the second filter portion 220, or the fourth filter portion 240, and may be caused to function as the third filter portion.

The discharging flow path 159 may be connected to the first filter portion 210. That is, a fluid in the first upstream side filter chamber 212 may be discharged to the outside of the first upstream side filter chamber 212 through the discharging flow path 159, by connecting the discharging flow path 159 to the first upstream side filter chamber 212.

The first filter portion 210 to the fourth filter portion 240 may be configured so as not to be exchanged.

A discharging operation of driving the circulating pump 190 may be performed in a state in which the maintenance unit 50 caps the liquid ejecting unit 41.

In the discharging operation, a maximum pressure difference which occurs between the upstream side of the third gas-liquid interface 313 which is formed in the nozzle opening 44 and the space side may be larger than the third pressure difference ΔPC. In a case in which the maximum pressure difference is larger than the third pressure difference ΔPC, it is preferable to perform suctioning cleaning or pressurizing cleaning after the discharging operation.

In the filling operation, it may be a configuration in which the valve opening mechanism 290 alternately pressurizes and depressurizes the first intermediate storage body 121 and the second intermediate storage body 122 in a state in which the communicating hole 281 is opened, and the liquid supply flow path 150 is filled with liquid which is supplied from the intermediate storage body 120 in a pressurizing manner.

In a case in which it is possible to fill the liquid supply flow path 150 with liquid which is stored in one of the intermediate storage body 120 of the first intermediate storage body 121 and the second intermediate storage body 122, it may be a configuration in which the valve opening mechanism 290 opens the communicating hole 281, in a state in which one intermediate storage body 120 is pressurized, and liquid which is supplied from the intermediate storage body 120 in a pressurizing manner is filled in the liquid supply flow path 150.

The liquid supply device 100 may be provided with only any one of the first intermediate storage body 121 and the second intermediate storage body 122 as the intermediate storage body 120.

It may be a configuration in which a sending pump is provided between the third on-off valve 163 of the sixth liquid flow path 156 and the connection portion 160, and liquid can be supplied in a pressurizing manner into the liquid supply flow path 150 as the downstream side of the sending pump of the sixth liquid flow path 156.

It may be a configuration in which at least one of the intermediate storage body 120 (121 and 122) and the liquid supply source 101 is disposed at the vertically higher part of the liquid ejecting unit 41 (opening position of nozzle opening 44), and liquid can be supplied in a pressurizing manner into the liquid supply flow path 150 using a water head difference.

The fluid flow path 158 may not form the circulating flow path 157. In this case, it is possible to discharge a fluid (liquid) to a wasted liquid collecting portion which is separately provided, and is out of the liquid flow path from the other end on the opposite side of one end of the fluid flow path 158 which is connected to the first upstream side filter chamber 212 included in the first filter portion 210.

In a case in which the fluid flow path 158 can discharge a fluid (liquid) from the other end which is the opposite side of the one end which is connected to the first upstream side filter chamber 212 to the outside of the liquid flow path, the circulating pump 190 which is provided in the fluid flow path 158 may be driven for a predetermined time, in a state in which at least one intermediate storage body 120 of the first intermediate storage body 121 and the second intermediate storage body 122 is pressurized. Liquid may be filled to the first upstream side filter chamber 212 of the first filter portion 210 of the liquid supply flow path 150, by discharging a fluid (mainly gas) in the liquid supply flow path 150 from the other end of the fluid flow path 158. In addition, it may be a configuration in which the suctioning pump 52 is driven for a predetermined time in a state in which the liquid ejecting unit 41 is capped, and liquid is filled by discharging a fluid (mainly gas) in the liquid supply flow path 150 on the downstream side of the first upstream side filter chamber 212 of the first filter portion 210 from the nozzle opening 44 of the liquid ejecting unit 41. In addition, when liquid is filled to the first upstream side filter chamber 212 of the first filter portion 210 by driving the circulating pump 190 for a predetermined time, it is preferable to set the liquid ejecting unit 41 to a closed state by capping thereof, and set so that air rarely flows in from the nozzle opening 44.

In a filling operation in which liquid in the liquid supply source 101 is filled in the liquid supply flow path 150, discharging of gas using the degassing mechanism 270 may be performed. In addition, after the filling operation, discharging of gas using the degassing mechanism 270 may be performed.

The liquid ejecting apparatus 10 may have a configuration of not being provided with the circulating flow path 157 and the fluid flow path 158.

A size of foreign substances which can be collected by the second filter 221 may be smaller than a size of foreign substances which can be collected by the first filter 211. A size of foreign substances which can be collected by the second filter 221 may be the same as the size of foreign substances which can be collected by the first filter 211. That is, a filtration grain size of the second filter 221 may be a filtration grain size of the first filter 211 or less.

A size of foreign substances which can be collected by the first filter 211 to the fourth filter 241 may be larger than the minimum size of the nozzle opening 44. A size of foreign substances which can be collected by the first filter 211 to the fourth filter 241 may be the same as the minimum size of the nozzle opening 44. That is, a filtration grain size of the first filter 211 to the fourth filter 241 may be the minimum size of the nozzle opening 44 or more.

The liquid ejecting apparatus may be a liquid ejecting apparatus which ejects or discharges liquid other than ink. As a state of liquid which is discharged from the liquid ejecting apparatus as droplets of a minute amount, a granular shape, a tear shape, and a thread shape leaving a trail is included. The liquid referred to here may be a material which can be ejected from the liquid ejecting apparatus. For example, the liquid may be in a state when the material is liquid phase, and includes a fluid body such as a liquid body having high or low viscosity, a sol, a gel, and inorganic solvent, organic solvent, liquid, a liquid resin, and liquid metal (metallic melt) other than that. The liquid is not limited to only liquid as a state of a material, and includes particles of a functional material which is formed of a solid body such as a pigment, or metallic particles are melted, diffused, or mixed in a solvent are also included. As a representative example of liquid, there is ink, liquid crystal, or the like, which is described in the above described embodiment. Here, the ink includes general water-based ink and oil-based ink, and a variety of liquid compositions such as gel ink, hot-melt ink, or the like. As specific examples of the liquid ejecting apparatus, for example, they may be a liquid ejecting apparatus which ejects liquid including a material such as an electrode material, or a color material which is used when manufacturing, for example, a liquid crystal display, an EL (electroluminescence) display, a surface emission display, a color filter, or the like, in a form of dispersion, or dissolution. It may be a liquid ejecting apparatus which ejects a biological organic substance which is used when manufacturing a biochip, a liquid ejecting apparatus which ejects liquid as a sample which is used as a precision pipette, a textile printing device, a micro-dispenser, or the like. It may be a liquid ejecting apparatus which ejects a lubricant to a precision machine such as a clock, a camera, or the like, using a pinpoint, a liquid ejecting apparatus which ejects transparent resin liquid such as a UV curable resin for forming a micro bulls-eye (optical lens) which is used in an optical communication element, or the like, onto a substrate. It may be a liquid ejecting apparatus which ejects etching liquid such as an acid or alkali for etching a substrate or the like.

The entire disclosure of Japanese Patent Application No. 2017-117475, filed Jun. 15, 2017 is expressly incorporated by reference herein.

What is claimed is:

1. A liquid ejecting apparatus comprising:

a liquid ejecting unit which includes a nozzle opening which ejects liquid;

a liquid supply flow path configured to supply the liquid to the nozzle opening of the liquid ejecting unit from a liquid supply source; and a filter portion which includes a filter which is provided with a plurality of holes through which a fluid passes, the filter collecting foreign substances, the filter portion including a liquid supply source side filter chamber located closer to the liquid supply source than the filter and adjacent to the filter, the filter portion including a nozzle opening side filter chamber located closer to the nozzle opening than the filter and adjacent to the filter, and the filter portion configuring a part of the liquid supply flow path, wherein, in a filling operation in which the liquid supply flow path in a state of not being filled with the liquid is filled with the liquid in the liquid supply source, by causing a pressure to be operated so as to make a pressure on the nozzle opening side filter chamber lower than a pressure on the liquid supply source side filter chamber, a maximum pressure difference which occurs between the liquid supply source side filter chamber and the nozzle opening side filter chamber is larger than a pressure difference ΔPA and smaller than a pressure difference ΔPB, the pressure difference ΔPA being a pressure difference for breaking a gas-liquid interface which is formed in a hole of the plurality of holes when the liquid supply source side of the filter is the liquid and the nozzle opening side of the filter is gas by causing a pressure to be operated so as to make a pressure on the nozzle opening side filter chamber lower than a pressure on the liquid supply source side filter chamber, and the pressure difference ΔPB being a pressure difference for breaking a gas-liquid interface which is formed in the hole of the plurality of holes when the liquid supply source side of the filter is the gas and the nozzle opening side of the filter is the liquid by causing a pressure to be operated so as to make a pressure on the nozzle opening side filter chamber lower than a pressure on the liquid supply source side filter chamber.

2. The liquid ejecting apparatus according to claim 1, wherein a size of foreign substances collectable by the filter is smaller than a minimum size of the nozzle opening.

3. The liquid ejecting apparatus according to claim 1, further comprising:

a second filter portion which is located closer to the liquid supply source than a first filter portion, and configures a part of the liquid supply flow path when the filter is set to the first filter, and the filter portion is set to the first filter portion, wherein the second filter portion includes a second filter which is provided with a plurality of holes through which a fluid can pass, and collects foreign substances, and wherein a size of the foreign substances collectable by the second filter is larger than a size of foreign substances collectable by the first filter, and is smaller than a minimum size of the nozzle opening.

4. The liquid ejecting apparatus according to claim 1, further comprising:

a fluid flow path configured to discharge a fluid in the liquid supply source side filter chamber to the outside of the liquid supply source side filter chamber without passing through the nozzle opening side filter chamber.

5. The liquid ejecting apparatus according to claim 4, wherein, in a discharging operation in which the fluid in the liquid supply source side filter chamber is discharged to the outside of the liquid supply source side filter chamber, in a case in which a pressure operated in the liquid supply flow path closer to the nozzle opening than the filter portion is lower than a pressure in a space to which the nozzle opening opens, a maximum pressure difference which occurs between the liquid supply source side of a gas-liquid interface which is formed in the nozzle opening and the space is smaller than a pressure difference for breaking the gas-liquid interface which is formed in the nozzle opening.

6. The liquid ejecting apparatus according to claim 4, further comprising:

a third filter portion which is different from the filter portion; and a discharging flow path which is connected to the third filter portion, wherein one end of the fluid flow path is connected to the liquid supply source side filter chamber, the other end thereof is connected to an upstream position closer to the liquid supply source than the liquid supply source side filter chamber in the liquid supply flow path, and the fluid flow path forms a circulating flow path through which the liquid circulates along with the liquid supply flow path, wherein the third filter portion includes a filter which collects foreign substances, and exchangeably configures a part of the circulating flow path, and wherein the discharging flow path is configured to discharge the fluid to the outside of the circulating flow path.

7. A filling method of a liquid ejecting apparatus which includes a liquid ejecting unit which includes a nozzle opening which ejects liquid; a liquid supply flow path configured to supply the liquid to the nozzle opening of the liquid ejecting unit from a liquid supply source: and a filter portion which includes a filter which is provided with a plurality of holes through which a fluid passes, the filter collecting foreign substances, the filter portion including a liquid supply source side filter chamber located closer to the liquid supply source than the filter and adjacent to the filter, the filter portion including a nozzle opening side filter chamber located closer to the nozzle opening than the filter and adjacent to the filter, and the filter portion configuring a part of the liquid supply flow path, in which, the liquid supply flow path in a state of not being filled with liquid is filled with the liquid in the liquid supply source by causing a pressure to be operated so as to make a pressure on the nozzle opening side filter chamber lower than a pressure on the liquid supply source side filter chamber, the method comprising:

causing, in the filter portion, a maximum pressure difference which occurs between the liquid supply source side filter chamber and the nozzle opening side filter chamber to be larger than a pressure difference ΔPA, the pressure difference ΔPA being a pressure difference for breaking a gas-liquid interface which is formed in a hole of the plurality of holes when the liquid supply source side of the filter is the liquid and the nozzle opening side of the filter is gas by causing a pressure to be operated so as to make a pressure on the nozzle opening side filter chamber lower than a pressure on the liquid supply source side filter chamber; and causing the maximum pressure difference to be smaller than a pressure difference ΔPB, the pressure difference ΔPB being a pressure difference for breaking a gas-liquid interface which is formed in the hole of the plurality of holes when the liquid supply source side of the filter is the gas and the nozzle opening side of the filter is the liquid by causing a pressure to be operated so as to make a pressure on the nozzle opening side filter chamber lower than a pressure on the liquid supply source side filter chamber.

* * * * *